US008258915B2

(12) United States Patent
Koto

(10) Patent No.: US 8,258,915 B2
(45) Date of Patent: Sep. 4, 2012

(54) NTC THERMISTOR CERAMIC AND NTC THERMISTOR USING THE SAME

(75) Inventor: Kiyohiro Koto, Higashiohmi (JP)

(73) Assignee: Murata Manufacturing Co., Ltd., Nagaokakyo-Shi, Kyoto-fu (JP)

( * ) Notice: Subject to any disclaimer, the term of this patent is extended or adjusted under 35 U.S.C. 154(b) by 100 days.

(21) Appl. No.: 12/414,287

(22) Filed: Mar. 30, 2009

(65) Prior Publication Data

US 2009/0179732 A1 Jul. 16, 2009

Related U.S. Application Data

(63) Continuation of application No. PCT/JP2007/068136, filed on Sep. 19, 2007.

(30) Foreign Application Priority Data

Sep. 29, 2006 (JP) ..... 2006-266976

(51) Int. Cl.
*H01C 7/10* (2006.01)

(52) U.S. Cl. ..... 338/22 R; 338/20

(58) Field of Classification Search ..... 338/20, 338/21, 22 R

See application file for complete search history.

(56) References Cited

U.S. PATENT DOCUMENTS 5,075,665 A * 12/1991 Taira et al. ..... 338/21
6,063,311 A * 5/2000 Takeuchi et al. ..... 252/521.2
6,147,587 A * 11/2000 Hadano et al. ..... 338/21
6,163,246 A * 12/2000 Ueda et al. ..... 338/331
6,518,632 B1 2/2003 Yoshida et al.
6,593,844 B1 7/2003 Iwao et al.

FOREIGN PATENT DOCUMENTS

JP 63-315548 A 12/1988
JP 63-315551 A 12/1988
JP 63-315552 A 12/1988
JP 63-315554 A 12/1988
JP 63-315561 A 12/1988
JP 6211202 A 8/1994
JP 2000068110 A 3/2000
JP 03-054147 B1 6/2000

(Continued)

OTHER PUBLICATIONS

International Search Report for PCT/JP2007/068136 dated Dec. 18, 2007.

(Continued)

*Primary Examiner* — Kyung Lee
(74) *Attorney, Agent, or Firm* — Dickstein Shapiro LLP.

(57) ABSTRACT

A NTC thermistor ceramic having higher voltage resistance and a NTC thermistor are provided. The NTC thermistor ceramic either contains manganese and nickel, the manganese/nickel content ratio being is 87/13 to 96/4, or the manganese/cobalt content ratio being is 60/40 or more and 90/10 or less. The NTC thermistor ceramic includes a first phase, which is a matrix, and a second phase composed of plate crystals dispersed in the first phase, the second phase has an electrical resistance higher than that of the first phase and a higher manganese content than the first phase, and the first phase has a spinel structure. A NTC thermistor includes a ceramic element body composed of the NTC thermistor ceramic having the above-described features, internal electrode layers formed inside the ceramic element body, and external electrode layers disposed on two side faces of the ceramic element body.

13 Claims, 10 Drawing Sheets

FOREIGN PATENT DOCUMENTS

| | | | |
|---|---|---|---|
| JP | 2001307907 | A | 11/2001 |
| JP | 3430023 | | 5/2003 |
| JP | 2005-150289 | A | 6/2005 |
| JP | 2003150289 | | 6/2005 |

OTHER PUBLICATIONS

Couderc J.J., Brieu M., Fritsch S., Rousset A. "Domain Microstructure in Hausmannite $Mn_3o_4$ and in Nickel Manganite" Third Euro-Ceramics V.1, pp. 763-768. Faanze Editrica Iberica S.L. 1993 Spain.

G.D.C. Csete De Gyorgyfalva and I.M. Reaney. "Decomposition of NiMn2O4 spinels". J. Mater. Res., vol. 18, No. 6, Jun. 2003.

M. Brieu, J.J. Couderc, A. Rousset, R. Legros. "TEM Characterization of Nickel and Nickel-Cobalt Manganite Ceramics". Journal of the European ceramic Society 0955-2219/93. 1993 Elsevier Science Publishers Ltd, England.

JPO Office Action, from JP 2008-537445, mailed Jan. 31, 2012.

* cited by examiner

NTC THERMISTOR CERAMIC AND NTC THERMISTOR USING THE SAME

This is a continuation-in-part of application Serial No. PCT/JP2007/068136, filed Sep. 19, 2007.

TECHNICAL FIELD

The present invention generally relates to NTC thermistor ceramics and in particular to NTC thermistor ceramics suitable for use in a NTC thermistor for suppressing inrush current generated when a power switch is turned ON, and a NTC thermistor.

BACKGROUND ART

NTC thermistors known in the art have been roughly categorized into two types depending on the usage, and temperature-compensating thermistors and inrush current-limiting thermistor. Among these, inrush current-limiting NTC thermistors are mainly built into power circuits and used for limiting the large inrush current that instantaneously flows when the capacitors in the circuits start charge accumulation upon turning on the power source.

One example of the above-described NTC thermistors known in the art is a multilayer NTC thermistor shown in FIG. 3. In this multilayer NTC thermistor, for example, internal electrode layers 11 are embedded in a ceramic element body 20 having a negative resistance temperature characteristic and extend to be exposed in two end faces in an alternating manner. External electrodes 12 are formed on the two end faces of the ceramic element body 20 and are electrically connected to the exposed internal electrode layers 11.

Various thermistor ceramic compositions that contain metal oxides containing manganese (Mn) and nickel (Ni) as main components have been known as the material for the ceramic element body.

For example, Japanese Unexamined Patent Application Publication No. 62-11202 (Patent Document 1) describes a thermistor composition including an oxide containing three elements, namely, manganese, nickel, and aluminum, in which the ratios of these elements are within the ranges of 20 to 85 mol % manganese, 5 to 70 mol % nickel, and 0.1 to 9 mol % aluminum, the total of the three elements being 100 mol %.

Another example, Japanese Patent No. 3430023 (Patent Document 2), describes a thermistor composition in which 0.01 to 20 wt % cobalt oxide, 5 to 20 wt % copper oxide, 0.01 to 20 wt % iron oxide, and 0.01 to 5.0 wt % zirconium oxide are added to a metal oxide, containing, in terms of the content of the metals only, 50 to 90 mol % manganese and 10 to 50 mol % nickel totaling to 100 mol %.

Another example is Japanese Unexamined Patent Application Publication No. 2005-150289 (Patent Document 3) which describes a thermistor composition containing a manganese oxide, a nickel oxide, an iron oxide, and a zirconium oxide, in which a mol % (wherein a is 45 to 95 excluding 45 and 95) manganese oxide in term of Mn and (100-a) mol % nickel oxide in terms of Ni are contained as main components, and per 100 wt % of these main components, the ratios of the respective components are 0 to 55 wt % (excluding 0 wt % and 55 wt %) iron oxide in terms of $Fe_2O_3$ and 0 to 15 wt % (excluding 0 wt % and 15 wt %) zirconium oxide in terms of $ZrO_2$.

Meanwhile, COUDERC J. J., BRIEU M., FRITSCH S, and ROUSSET A., *DOMAIN MICROSTRUCTURE IN HAUSMANNITE $Mn_3O_4$ AND IN NICKEL MANGANITE*, THIRD EURO-CERAMICS, VOL. 1 (1993) pp. 763-768 (Non-Patent Document 1) reports a thermistor ceramic composition in which plate-shaped deposits which are generated by gradually cooling $Mn_3O_4$ from high temperature (cooling rate: 6° C./hr) but not when $Mn_3O_4$ is rapidly cooled from high temperature in air, giving instead a lamella structure (stripe-shaped contrast structure). In addition, this document also reports that $NiO_{0.75}Mn_{2.25}O_4$ forms a spinel single phase when gradually cooled from high temperature (cooling rate: 6° C./hr) in which no plate-shaped deposits or lamella structures are observed, and forms a lamella structure but not plate-shaped deposits when rapidly cooled from high temperature in air.

Patent Document 1: Japanese Unexamined Patent Application Publication No. 62-11202

Patent Document 2: Japanese Patent No. 3430023

Patent Document 3: Japanese Unexamined Patent Application Publication No. 2005-150289

Non-Patent Document 1: COUDERC J. J., BRIEU M., FRITSCH S, and ROUSSET A., *DOMAIN MICROSTRUCTURE IN HAUSMANNITE $Mn_3O_4$ AND IN NICKEL MANGANITE*, THIRD EURO-CERAMICS, VOL. 1 (1993) pp. 763-768

DISCLOSURE OF INVENTION

Problems to be Solved by the Invention

When thermistor ceramic compositions proposed in the above-described documents are used to make inrush current-limiting NTC thermistors, the insufficient dispersion of raw materials results in inhomogeneous dispersion of the compounds forming the ceramic, and a variation in ceramic grain diameters of the raw materials results in local formation of low-resistance regions in the thermistor element bodies of the resulting NTC thermistors. If current, such as inrush current, flows in such NTC thermistor element bodies (FIG. 10), the inrush current may concentrate on the low-resistance portions of the NTC thermistor element bodies, the temperature of the current-concentrated portions may rise, and the NTC thermistor element bodies may be melted by the heat. In other words, the existing thermistor ceramics may have insufficient voltage resistance depending on the manufacturing conditions, such as variation in ceramic grain diameters and insufficient dispersion of raw materials.

The documents described above report that different crystal structures can be derived from $Mn_3O_4$ and $NiO_{0.75}Mn_{2.25}O_4$, i.e., the thermistor compositions, by changing the cooling rate from high temperature. However, the inventor of the present invention has found that none of the crystal structures of these compositions has sufficient voltage resistance.

An object of the present invention is to provide a NTC thermistor ceramic having excellent voltage resistance and a NTC thermistor.

Means for Solving the Problems

In order to attain the object described above, the inventor assumed that the fracture mode caused by inrush current is attributable to the thermal melting of and cracks in the NTC thermistor element bodies, and studied various compositions and crystal structures. As a result, the inventor has found that the voltage resistance can be enhanced when a different phase having a relatively high electrical resistance and containing plate crystals is dispersed in the matrix. The present invention has been made on the basis of this finding.

A NTC thermistor ceramic of this invention includes a first phase, which is a matrix, and a second phase dispersed in the first phase, in which the second phase includes plate crystals and has an electrical resistance higher than that of the first phase.

According to the NTC thermistor ceramic of this invention, the second phase composed of plate crystals having a higher electrical resistance than the first phase exists in the first phase, i.e., the matrix. The present inventor conducted extensive investigations and found that even when regions having a low electrical resistance are locally formed in a NTC thermistor ceramic mainly composed of Mn, the potential gradient that occurs in the matrix as a result of concentration of electrical current in the low-resistance regions during application of inrush current can be moderated by the presence of a dispersed high-electrical-resistance phase having a higher resistance than the matrix. As a result, the electrical field concentration on the low-resistance regions can be moderated, and fracture caused by heat melting of the thermistor element body can be suppressed. Thus, the voltage resistance of a NTC thermistor using the NTC thermistor ceramic of the present invention can be further improved.

In the NTC thermistor ceramic of the present invention, preferably, the first and second phases contain manganese and the manganese content in the second phase is higher than that in the first phase.

In this manner, the electrical resistance of the second phase can be made higher than that of the first phase. Thus, fracture caused by heat melting can be suppressed, and the voltage resistance of the NTC thermistor ceramic can be improved. Furthermore, since the main components of the first and second phases are the same, no complicated synthetic process is needed in depositing plate crystals, and strains and cracks are not readily generated since the it is easy to bond the first phase to the second phase.

According a NTC thermistor ceramic according to one aspect of the present invention, preferably, the first phase has a spinel structure, the first and second phases contain manganese and nickel, the (manganese content)/(nickel content) ratio of the NTC thermistor ceramic as a whole is or more and 96/4 or less, and the NTC thermistor ceramic contains 0 at % to 15 at % copper, 0 at % to 10 at % aluminum, 0 at % to 10 at % iron, 0 at % to 15 at % cobalt, 0 at % to 5 at % titanium, and 0 at % to 1.5 at % zirconium.

According to this aspect, a structure in which a high-resistance phase having a higher electrical resistance than the matrix exists in the matrix can be achieved, the hardness of the NTC thermistor ceramic can be increased, and the toughness can be improved. As a result, not only fracture caused by heat melting is suppressed but also fracture attributable to cracks can be suppressed. Thus, the voltage resistance of the NTC thermistor ceramic can be further improved.

Incorporating 10 at % or less aluminum, 10 at % or less iron, 15 at % or less cobalt, and 5 at % or less titanium further improves the hardness or fracture toughness of the NTC thermistor ceramic. Thus, fracture attributable to cracks can be suppressed further and the voltage resistance can be further improved.

Incorporating 1.5 at % or less zirconium allows zirconium oxide to segregate in the grain boundaries of the ceramic crystal grains and thus improves mechanical properties of the grain boundaries of the ceramic crystal grains composed of the NTC thermistor ceramic. Thus, fracture attributable to cracks can be suppressed, and the voltage resistance can be further improved as a result.

According to a NTC thermistor ceramic of another aspect of the present invention, preferably, the first phase has a spinel structure, the first and second phases contain manganese and cobalt, the (manganese content)/(cobalt content) ratio of the NTC thermistor ceramic as a whole is 60/40 or more and 90/10 or less, and the NTC thermistor ceramic contains 0 at % to 22 at % copper, 0 at % to 15 at % aluminum, 0 at % to 15 at % iron, 0 at % to 15 at % nickel, and 0 at % to 1.5 at % zirconium.

According to this aspect, a structure in which a high-resistance phase having a higher electrical resistance than the matrix exists in the matrix can be achieved, the hardness of the NTC thermistor ceramic can be increased, and the toughness can be improved. As a result, not only fracture caused by heat melting is suppressed but also fracture attributable to cracks can be suppressed. Thus, the voltage resistance of the NTC thermistor ceramic can be further improved.

Incorporating 15 at % or less aluminum, 15 at % or less iron, and 15 at % or less nickel further improves the hardness or fracture toughness of the NTC thermistor ceramic. Thus, fracture attributable to cracks can be suppressed further and the voltage resistance can be further improved.

Incorporating 1.5 at % or less zirconium allows zirconium oxide to segregate in the grain boundaries of the ceramic crystal grains and thus improves mechanical properties of the grain boundaries of the ceramic crystal grains composed of the NTC thermistor ceramic. Thus, fracture attributable to cracks can be suppressed, and the voltage resistance can be further improved as a result.

The NTC thermistor ceramic of the present invention having any one of the features described above preferably further includes a third phase different from the second phase dispersed in the first phase, and the third phase preferably has an electrical resistance higher than that of the first phase.

In this manner, a third phase having an electrical resistance higher than that of the first phase exists in the first phase, i.e., in addition to the matrix and the second phase composed of plate crystals and having a higher electrical resistance than the first phase. Since another high-resistance phase different from the first high-resistance phase composed of plate crystals exists in the matrix, the potential gradient in the matrix can be decreased and local electrical field concentration can be moderated when excessive inrush current is applied. Thus, fracture caused by heat melting can be suppressed. The voltage resistance of the NTC thermistor ceramic can be increased.

Increasing the copper content in pursuing further improvements in voltage resistance sometimes generates cracks and the like during firing. However, the resistivity of the material at room temperature, at a low copper content, tends to be high. The invention having the above-described features can lower the resistivity at room temperature while maintaining high voltage resistance.

In such a case, the third phase preferably contains an alkaline earth element.

In the composition constituting the NTC thermistor ceramic of the present invention having the above-described features, preferably, the first phase has a spinel structure, the first and second phases contain manganese and nickel, the (manganese content)/(nickel content) ratio of the NTC thermistor ceramic as a whole is 87/13 or more and 96/4 or less, and the NTC thermistor ceramic contains 0 at % to at % copper, 0 at % to 10 at % aluminum, 0 at % to 10 at % iron, 0 at % to 15 at % cobalt, and 0 at % to 5 at % titanium, and further contains, as the alkaline earth metal, at least one element selected from the group consisting of calcium and strontium, the calcium content being 10 at % or less (excluding 0 at %) and the strontium content being 5 at % or less (excluding 0 at %).

In another composition constituting the NTC thermistor ceramic of the present invention having the above-described features, the first phase has a spinel structure, the first and second phases contain manganese and cobalt, the (manganese content)/(cobalt content) ratio of the NTC thermistor ceramic as a whole is 60/40 or more and 90/10 or less, and the NTC thermistor ceramic contains 0 at % to 22 at % or less copper, 0 at % to 15 at % aluminum, 0 at % to 15 at % iron, and 0 at % to 15 at % nickel, and further contains, as the alkaline earth element, at least one element selected from the group consisting of calcium and strontium, the calcium content being 5 at % or less (excluding 0 at %) and the strontium content being 5 at % or less (excluding 0 at %).

In this manner, the voltage resistance of the NTC thermistor ceramic can be further improved, and a structure having a low electrical resistivity at room temperature can be achieved.

A NTC thermistor according to the present invention includes a thermistor element body composed of the NTC thermistor ceramic having any of the features described above and an electrode disposed on a surface of the thermistor element body.

In this manner, a NTC thermistor with high voltage resistance suitable for limiting high inrush current can be achieved.

ADVANTAGES

According to this invention, the voltage resistance of the NTC thermistor ceramic can be improved, and a NTC thermistor with high voltage resistance suitable for limiting high inrush current can be made using this NTC thermistor ceramic.

REFERENCE NUMERALS

Figure 1:
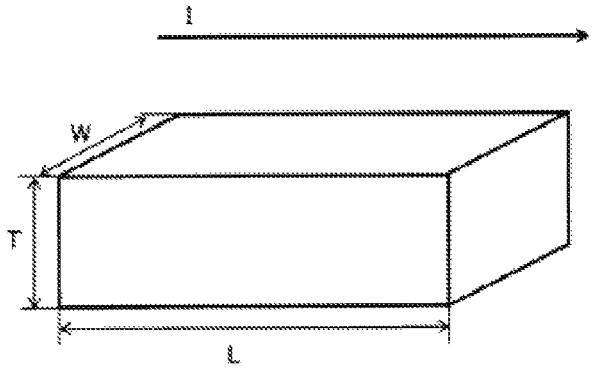
FIG. 1 is a diagram for explaining how to calculate specific resistance in EXAMPLES.

1: NTC thermistor, 11: internal electrode layer, 12: external electrode layer, 20: ceramic element body

BEST MODES FOR CARRYING OUT THE INVENTION

The present inventor has made the following investigations on the reason why the voltage resistance of existing NTC thermistor ceramics is insufficient:

(1) First, the inventor assumed that the fracture mode caused by excessive inrush current is attributable to thermal melting as one of the reasons for insufficient voltage resistance. When the temperature of a NTC thermistor rises, its electrical resistance decreases. For example, when disintegration of the raw materials is insufficient and compounds forming the ceramic are dispersed inhomogeneously or when the ceramic grain diameters of the raw materials have a variation, the NTC thermistor ceramic may locally have portions with a low electrical resistance. When an inrush current is applied to such a NTC thermistor, the inrush current concentrates on portions with low electrical resistance, thereby raising the temperature of those portions. As a result, the electrical resistance of those portions becomes lower than the electrical resistance of other portions, and this promotes further concentration of electrical current. Consequently, electrical current concentrates on one region, further elevating the temperature and melting the ceramic constituting the thermistor element body, and the melted portion becomes a starting point of the fracture.

A NTC thermistor ceramic of the present invention contains, in its matrix, a phase composed of plate crystals and having a high electrical resistance relative to the matrix. Simulation results by finite element analysis have shown that according to this structure, the potential gradient in the matrix decreases when inrush current is applied. Based on these results, it has been found that presence of a high-resistance phase having a high resistance relative to the matrix moderates the local electrical field concentration in the matrix and suppresses fracture caused by thermal melting.

(2) Next, the inventor assumed that the fracture mode caused by inrush current is attributable to cracks as another reason for insufficient voltage resistance. The ceramic constituting a NTC thermistor ceramic undergoes thermal expansion with an increase in temperature. Thus, the ceramic is required to exhibit a strength that can withstand the thermal expansion in order to enhance the voltage resistance.

According to one embodiment of the present invention, the first phase has a spinel structure, the first and second phases contain manganese and nickel, and the (manganese content)/(nickel content) ratio of the NTC thermistor ceramic as a whole is 87/13 or more and 96/4 or less. The experiments conducted by the inventor have shown that a composition having a high hardness or a high fracture toughness can be obtained as the (manganese content)/(nickel content) ratio becomes higher. Based on these results, it is assumed that increasing the manganese content helps achieve a high hardness or a high fracture toughness and suppress fracture caused by cracks.

The first phase has a spinel structure, the first and second phases contain manganese and nickel, the (manganese content)/(nickel content) ratio of the NTC thermistor ceramic as a whole is 87/13 or more and 96/4 or less, the NTC thermistor ceramic contains 0 at % to 15 at % copper, 0 at % to 10 at % aluminum, 0 at % to 10 at % iron, 0 at % to 15 at % cobalt, 0 at % to 5 at % titanium, and 0 at % to 1.5 at % zirconium, and the manganese content in the second phase is higher than that of the first phase.

The basic structure of the NTC thermistor ceramic according to another preferred embodiment of the present invention includes a first phase which is a matrix having a spinel structure and a second phase dispersed in the first phase and composed of a plurality of plate crystals, in which the second phase shows a higher electrical resistance than the first phase, the first and second phases contain manganese and cobalt, the (manganese content)/(cobalt content) ratio of the NTC thermistor ceramic as a whole is or more and 90/10 or less, and the manganese content in the second phase is higher than that of the first phase.

The first phase has a spinel structure, the first and second phases contain manganese and cobalt, the (manganese content)/(cobalt content) ratio of the NTC thermistor ceramic as a whole is 60/40 or more and 90/10 or less, the NTC thermistor ceramic contains 0 at % to 22 at % copper, 0 at % to 15 at % aluminum, 0 at % to 15 at % iron, 0 at % to 15 at % nickel, and 0 at % to 1.5 at % zirconium, and the manganese content in the second phase is higher than that of the first phase.

A NTC thermistor ceramic of any embodiment of the present invention preferably further includes a third phase different from the second phase dispersed in the first phase, the third phase preferably has an electrical resistance higher than that of the first phase, and the third phase preferably contains an alkaline earth metal. In such a case, preferably, the NTC thermistor ceramic contains as an alkaline earth metal at least one element selected from the group consisting calcium and strontium, the calcium content is preferably in the range of 10 at % or less (excluding 0 at %) in a system containing manganese and nickel as main components or in the range of 5 at % or less (excluding 0 at %) in a system containing manganese and cobalt as main components, and the strontium content is preferably in the range of 5 at % or less (excluding 0 at %).

Although the first phase of the NTC thermistor ceramic according to the embodiment of the present invention described above has a spinel structure, compositions having structures other than the spinel structure can have structures that exhibit high voltage resistance. The first phase is thus not limited to one having a spinel structure. Furthermore, although the NTC thermistor ceramic of the embodiment of the present invention includes a second phase composed of plate crystals, the form of crystals is not limited. The second phase has an effect of increasing the voltage resistance if crystals having certain aspect ratios, such as plate and needle crystals, are dispersed in the first phase and the electrical resistance of the second phase is higher than that of the first phase. Such crystals have an average aspect ratio (long axis/short axis) of at least about 3:1 in the figure projected from three dimension to two dimension. Moreover, the NTC thermistor ceramic of the present invention may contain inevitable impurities such as sodium.

EXAMPLES

Examples of preparation of NTC thermistors of the present invention will now be described.

Example 1A

Manganese oxide ($Mn_3O_4$) and nickel oxide (NiO) were weighed and blended so that the atomic ratios (atom %) of the manganese (Mn) and nickel (Ni) after firing were adjusted to ratios indicated in Table 1. To the resulting mixture, poly (ammonium carboxylate) serving as a dispersant and pure water were added, and the resulting mixture was disintegrated by wet-mixing in a ball mill, i.e., a mixer and a disintegrator, for several hours. The resulting mixture powder was dried and calcined for 2 hours at a temperature of 650° C. to 1000° C. To the calcined powder, the dispersant and pure water were again added and the resulting mixture was disintegrated by wet-mixing in a ball mill for several hours. To the resulting mixture powder, a water-based binder resin, i.e., an acrylic resin, was added, and the resulting mixture was defoamed in a low vacuum of 500 to 1000 mHg to prepare a slurry. The slurry was formed by the doctor blade method on a carrier film constituted by a polyethylene terephthalate (PET) film and dried to prepare a green sheet 20 to 50 μm in thickness on the carrier film.

In the example described above, a ball mill was used as a mixer and an integrator. Alternatively, an attritor, a jet mill, and various other disintegrators may be used. For the method for forming the green sheet, pulling methods such as lip coating and roll coating may be used other than the doctor blade method.

The obtained green sheet was cut to a predetermined size, and a plurality of sheets were stacked to a certain thickness. Subsequently, the sheets were pressed at about $10^6$ Pa to prepare a multilayer green sheet compact.

The compact was cut into a predetermined shape and heated at a temperature of 300° C. to 600° C. for 1 hour to remove the binder. Then the compact was fired in the firing step described below to prepare a ceramic element body that served as the NTC thermistor ceramic of the present invention.

The firing step included a temperature-elevating process, a high temperature-retaining process, and a temperature-decreasing process. In the high temperature-retaining process, a temperature of 1000° C. to 1200° C. was maintained for 2 hours, and the temperature-elevating rate was 200° C./hour. The rate of temperature-decreasing was also 200° C./hour except when the temperature was in the range of 500° C. to 800° C. when it was about ½ of that temperature-decreasing rate. Plate crystals mainly composed of manganese oxide constituting a high-resistance second phase of the NTC thermistor ceramic of the present invention can be produced by decreasing the temperature-decreasing rate when the temperature is in the range of 800° C. to 500° C. to a level lower than that in other temperature ranges in the firing step. X-ray diffraction analysis (XRD) has found that plate crystals mainly composed of manganese oxide start to form in the temperature range of 700° C. to 800° C. in the temperature-decreasing process, and the number of crystals produced increases during the temperature-decreasing process down to 500° C. Moreover, gradual cooling (6° C./hour, requiring about 8.3 days) described in the prior art documents is not needed in the present invention, and the temperature-decreasing time can be about several hours, which is efficient. The firing atmosphere was air. The firing atmosphere may be oxygen gas.

Silver (Ag) electrodes were applied on both surfaces of the NTC thermistor element body and baked at 700° C. to 800° C. The resulting product was diced into a 1 $mm^2$ size to prepare a single plate-type NTC thermistor shown in FIG. 1, which was used as an evaluation sample.

The electrical characteristics of each sample of the single plate-type NTC thermistor with electrodes were measured by a DC four-terminal method (Hewlett Packard 3458A multimeter).

In Table 1, "ρ25" indicates the resistivity (Ωcm) at a temperature of 25° C., calculated from the equation below where R25 (Ω) is the electrical resistance at 25° C. when current I (A) flows in the length direction of a sample having a width W (cm), a length L (cm), and a thickness T (cm) as shown in FIG. 1:

$$\rho 25 = R25 \times W \times T/L$$

"B25/50" (K) is calculated from the equation below, where R25 (Ω) is the electrical resistance at a temperature of 25° C. and R50 (Ω) is the electrical resistance at a temperature of 50° C.:

$$B25/50 = (\log R25 - \log R50)/(1/(273.15+25) - 1/(273.15+50))$$

The results of the measurements on the NTC thermistors having ceramic element bodies containing manganese and nickel are shown in Table 1.

The voltage resistance of each sample of the NTC thermistor that includes a ceramic element body containing manganese and nickel as main metal elements was evaluated as follows. After the ceramic element body formed as a single plate was mounted on a substrate, leads were attached to the electrodes on the ceramic element body and a predetermined voltage was applied thereto to supply inrush current. Changes in electrical resistance at that time were measured. An ISYS low-temperature voltage resistance tester (model IS-062) was used as the measurement instrument.

As the inrush current flows into the NTC thermistor, the electrical resistance starts to increase rapidly after a certain current value is attained. Having high voltage resistance means that the electrical resistance does not change until a high current value is reached. In this example, the rate of change in electrical resistance ΔR25 when 10 A current was supplied to a NTC thermistor having a thickness of 0.65±0.05 mm was calculated to evaluate voltage resistance.

In Table 1, "voltage resistance" (%) is calculated by the equation below where $R_0 25$ (Ω) is the electrical resistance at a temperature of 25° C. before supplying the inrush current, and $R_1 25$ (Ω) is the electrical resistance at 25° C. after supplying 10 A inrush current:

$$\Delta R25 = (R_1 25/R_0 25 - 1) \times 100$$

TABLE 1

| No. | Mn atom % | Ni atom % | ρ25 Ωcm | B25/50 K | Voltage resistance % | Plate crystal | Judgment |
|---|---|---|---|---|---|---|---|
| 101 | 80 | 20 | 1920 | 3960 | 39 | No | X |
| 102 | 84 | 16 | 2334 | 3920 | 29 | No | X |
| 103 | 87 | 13 | 17600 | 4215 | −1 | Yes | ○ |
| 104 | 90 | 10 | 26890 | 4243 | −0.5 | Yes | ○ |
| 105 | 93 | 7 | 80473 | 4375 | 0.4 | Yes | ○ |
| 106 | 96 | 4 | 269383 | 4583 | −0.5 | Yes | ○ |

As shown in Table 1, it was confirmed that in all samples of single plate-type NTC thermistors having ceramic element bodies containing manganese and nickel as the main metal elements, plate crystals mainly composed of manganese oxide serving as the second phase having a high electrical resistance were dispersed in the first phase, i.e., the matrix having a high electrical resistance, when the atomic (manganese content)/(nickel content) ratio was in the range of 87/13 or more and 96/4 or less. In the "judgment" column of Table 1, samples in which generation of the second phase was observed are marked by circles and samples in which generation of the second phase was not observed are marked by X. It was found that sample Nos. 103 to 106 in which generation of the second phase was observed exhibited a "rate of change in electrical resistance ΔR25 after application of inrush current", i.e., the indicator of the voltage resistance, of 10% or less and thus had high voltage resistance.

Example 1B

Manganese oxide ($Mn_3O_4$), nickel oxide (NiO), and copper oxide (CuO) were weighed and blended so that the atomic ratios (atom %) of the manganese (Mn), nickel (Ni), and copper (Cu) after firing were adjusted to ratios shown in Table 2. Then green sheets were prepared as in EXAMPLE 1A.

The resulting green sheets were stacked, pressed, and fired as in EXAMPLE 1A to prepare a ceramic element body that served as the NTC thermistor ceramic of the present invention. Electrodes were formed on the ceramic main body as in EXAMPLE 1A to obtain a NTC thermistor.

The voltage resistance of each sample of a single plate-type NTC thermistor including a ceramic element body containing manganese, nickel, and copper as main metal elements prepared as above was evaluated as follows. After the ceramic element body formed as a single plate was mounted on a substrate, leads were attached to the electrodes on the ceramic element body and a predetermined voltage was applied thereto to supply inrush current. Changes in electrical resistance at that time were measured. An ISYS low-temperature voltage resistance tester (model IS-062) was used as the measurement instrument.

As the inrush current flows into the NTC thermistor, the electrical resistance starts to increase rapidly after a certain current value. Having high voltage resistance means that the electrical resistance does not change until a high current value is reached. In this example, the rate of change in electrical resistance ΔR25 when 10 A current is supplied to a NTC thermistor having a thickness of 0.65±0.05 mm was calculated to evaluate voltage resistance.

In Table 2, "ΔR25 after application of inrush current" (%) is calculated by the equation below where $R_0 25$ (Ω) is the electrical resistance at a temperature of 25° C. before supplying the inrush current, and $R_1 25$ (Ω) is the electrical resistance at 25° C. after supplying 10 A inrush current:

$$\Delta R25=(R_1 25/R_0 25-1)\times 100$$

In order to evaluate the reliability of the electrical resistance, the same type of NTC thermistor as above was used and the rate of change in electrical resistance ΔR25 after 100 cycles of heat test, each cycle including retaining at −55° C. for 30 minutes and at 125° C. for 30 minutes, was measured. The rate of change in electrical resistance ΔR25 is indicated as "reliability ΔR25" (%) in the table. The "reliability ΔR25" (%) is calculated by the following equation where $R_0 25$ (Ω) is the electrical resistance at a temperature of 25° C. before the heat cycle test, and $R_2 25$ (Ω) is the electrical resistance at 25° C. after the heat cycle test:

$$\Delta R25=(R_2 25/R_0 25-1)\times 100$$

In the "judgment" column of Table 2, samples having "ΔR25 after application of inrush current" of 10% or less and "reliability ΔR25" of 20% or less are marked by circles while other samples are marked by X.

Vickers's hardness was measured with AKASHI MICRO HARDNESS TESTER (model MVK-E). In Table 2, Vickers's hardness Hv and fracture toughness KIc are indicated.

TABLE 2

| | | Feed amounts of raw materials | | | Electrical characteristics | | Voltage resistance ΔR25% after | Vickers hardness | | | | |
|---|---|---|---|---|---|---|---|---|---|---|---|---|
| Composition No. | Mn/Ni ratio | Mn atom % | Ni atom % | Cu atom % | ρ25 Ωcm | B25/50 K | application of inrush current | Hv | KIc MN/m1.5 | Reliability ΔR25% | Plate crystal | Judgment |
| 107 | 73/27 | 69.7 | 25.8 | 4.5 | 178 | 3249 | 523 | 620 | 1.50 | 5.6 | No | X |
| 108 | 77/23 | 73.5 | 22.0 | 4.5 | 146 | 3329 | 323 | 644 | 1.69 | 13.0 | No | X |
| 109 | 80/20 | 76.4 | 19.1 | 4.5 | 171 | 3407 | 51 | 649 | 2.44 | 9.3 | No | X |
| 110 | 85/15 | 81.2 | 14.3 | 4.5 | 152 | 3220 | 24 | 627 | 3.04 | 10.1 | No | X |
| 111 | | 79.9 | 14.1 | 6.0 | 84 | 3084 | 76 | 645 | 2.46 | 13.9 | No | X |
| 112 | 87/13 | 74.0 | 11.0 | 15.0 | 102 | 2766 | 4 | 684 | 2.55 | 12.3 | Yes | ○ |
| 113 | 90/10 | 86.0 | 9.5 | 4.5 | 1220 | 3212 | 3 | 621 | 3.09 | 12.9 | Yes | ○ |
| 114 | | 84.6 | 9.4 | 6.0 | 707 | 3058 | 6 | 637 | 2.73 | 14.6 | Yes | ○ |
| 115 | | 81.5 | 9.0 | 9.5 | 218 | 2818 | 3 | 720 | 2.63 | 16.6 | Yes | ○ |
| 116 | | 80.1 | 8.9 | 11.0 | 152 | 2760 | 2 | 680 | 2.54 | 14.0 | Yes | ○ |
| 117 | | 78.8 | 8.7 | 12.5 | 174 | 2730 | 5 | 682 | 2.18 | 17.5 | Yes | ○ |
| 118 | | 76.5 | 8.5 | 15.0 | 67 | 2809 | 7 | 717 | 2.37 | 14.8 | Yes | ○ |
| 119 | 95/5 | 84.6 | 4.4 | 11.0 | 306 | 2665 | 2 | 634 | 2.91 | 10.7 | Yes | ○ |
| 120 | | 80.8 | 4.2 | 15.0 | 423 | 2679 | 3 | 661 | 2.64 | 8.0 | Yes | ○ |
| 121 | 96/4 | 81.6 | 3.4 | 15.0 | 513 | 2768 | 6 | 674 | 2.61 | 9.4 | Yes | ○ |
| 122 | 100/0 | 66.7 | 0 | 33.3 | 229 | 2889 | 24 | 350 | 1.70 | 12.0 | No | X |

As shown in Table 2, it was confirmed that all samples that exhibited high voltage resistance, i.e., "ΔR25 after application of inrush current" of 10% or less, in evaluation of the voltage resistance had an atomic (manganese content)/(nickel content) ratio in the range of 87/13 or more and 96/4 or less.

These results indicate that when a NTC thermistor ceramic contains manganese and nickel and the (manganese content)/(nickel content) ratio is 87/13 or more and 96/4 or less, a structure is realized in which a high-resistance phase having a high resistance relative to a matrix is present in the matrix, and the hardness or the fracture toughness of the composition can be further enhanced. This not only moderates the electrical current concentration in the first phase and suppresses fracture caused by heat melting but also limits fracture caused by cracks. Thus, the voltage resistance of the NTC thermistor ceramic can be further improved. Moreover, it is shown that a NTC thermistor ceramic designed to contain 15 at % or less copper can realize a structure capable of improving the voltage resistance of the NTC thermistor ceramic.

Next, composition No. 116 was analyzed with a scanning ion microscope (SIM) and a scanning transmission electron microscope (STEM) to observe ceramic grains and conduct energy dispersive X-ray fluorescent spectrometry (EDX).

Figure 2:
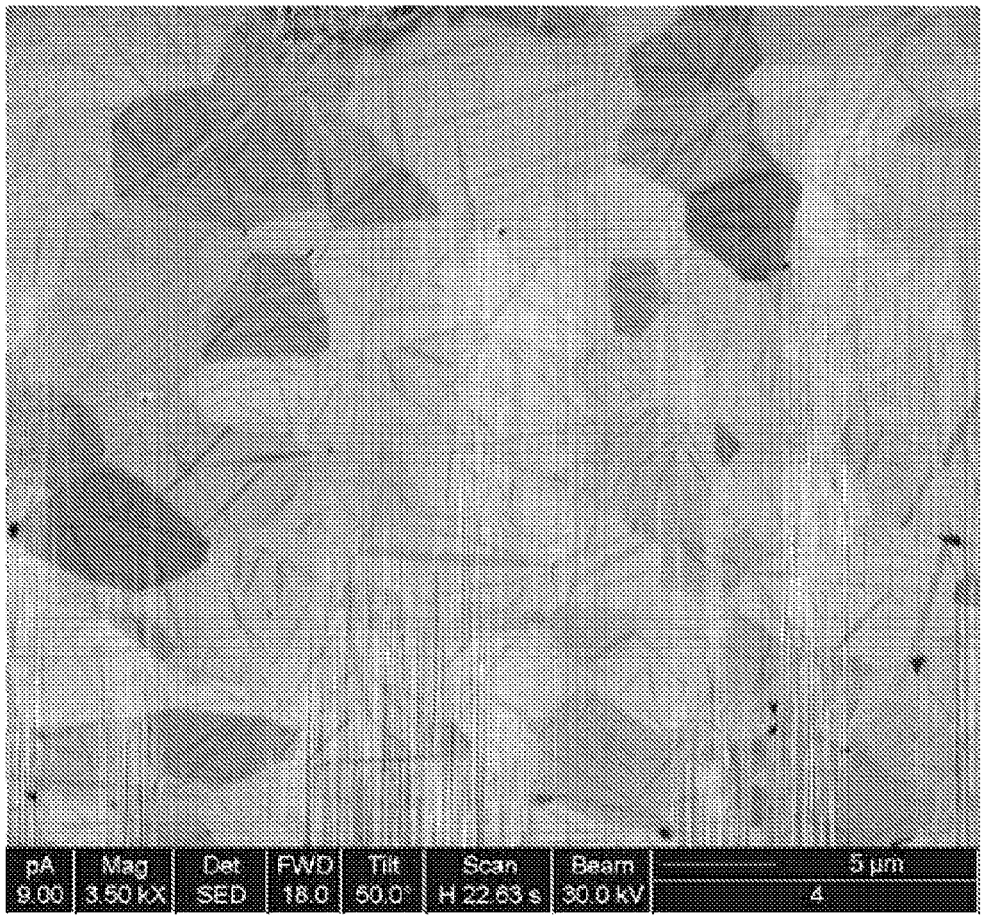
FIG. 2 is a photograph of ceramic crystal grains of a NTC thermistor ceramic which is one example of the present invention observed with a scanning ion microscope.

FIG. 2 is a photograph of ceramic grains observed with a scanning ion microscope. In FIG. 2, dispersed matter in the form of black lines is the plate crystals serving as the second phase.

According to the results of energy dispersive X-ray fluorescent spectrometry, the first phase, i.e., the matrix, contained 68.8 to 75.5 at % manganese, 11.3 to 13.7 at % nickel, and 13.1 to 19.9 at % copper, and the second phase composed of plate crystals and having a high resistance contained 95.9 to 97.2 at % manganese, 0.6 to 1.2 at % nickel, and 2.1 to 3.0 at % copper. These results show that the manganese content in the second phase is higher than that in the first phase. Although this slightly depends on the contents of other additives, the results show that the second phase contains 1.2 times as much manganese as the first phase in terms of atomic percent.

The electrical resistance of the first and second phases was directly measured by analysis using a scanning probe microscope (SPM). As a result, it was found that the electrical resistance of the second phase was higher than that of the first phase and was at least 10 times larger than the electrical resistance of the first phase.

Example 2a

Manganese oxide ($Mn_3O_4$), nickel oxide (NiO), copper oxide (CuO), aluminum oxide ($Al_2O_3$), iron oxide ($Fe_2O_3$), cobalt oxide ($CO_3O_4$), and titanium oxide ($TiO_2$) were weighed and blended so that the atomic ratios (atom %) of manganese (Mn), nickel (Ni), copper (Cu), aluminum (Al), iron (Fe), cobalt (Co), and titanium (Ti) after firing were adjusted to ratios shown in Table 3. Then green sheets were prepared as in EXAMPLE 1A.

The resulting green sheets were stacked, pressed, and fired as in EXAMPLE 1A to prepare a ceramic element body serving as the NTC thermistor ceramic of the present invention. Electrodes were formed on the ceramic main body as in EXAMPLE 1A to obtain a NTC thermistor.

The electrical characteristics, voltage resistance, and reliability of each sample of the single plate-type NTC thermistor were evaluated as in EXAMPLE 1B. The results are shown in Table 3.

TABLE 3

| | | Feed amounts of raw materials | | | | | | | Electrical characteristics | | Voltage resistance | Vickers hardness | | | | |
|---|---|---|---|---|---|---|---|---|---|---|---|---|---|---|---|---|
| Composition No. | Mn/Ni ratio | Mn atom % | Ni atom % | Cu atom % | Al atom % | Fe atom % | Co atom % | Ti atom % | ρ25 Ωcm | B25/50 K | ΔR25% after application of inrush current | Hv | Klc MN/m1.5 | Reliability ΔR25% | Plate crystal | Judgment |
| 123 | 85/15 | 76.5 | 13.5 | 5.0 | 5.0 | 0 | 0 | 0 | 200 | 3219 | 51 | 679 | 2.87 | 8.5 | No | X |
| 124 | | 75.7 | 13.3 | 6.0 | 5.0 | 0 | 0 | 0 | 113 | 3097 | 42 | 682 | 2.51 | 8.9 | No | X |
| 125 | 90/10 | 81.9 | 9.1 | 7.0 | 2.0 | 0 | 0 | 0 | 583 | 2960 | −3 | 652 | 2.70 | 13.9 | Yes | ○ |
| 126 | | 78.8 | 8.7 | 7.5 | 5.0 | 0 | 0 | 0 | 300 | 2900 | 0 | 753 | 2.61 | 0.6 | Yes | ○ |
| 127 | | 77.4 | 8.6 | 9.0 | 5.0 | 0 | 0 | 0 | 288 | 2843 | −5 | 659 | 2.37 | 13.8 | Yes | ○ |
| 128 | | 77.0 | 8.5 | 7.5 | 7.0 | 0 | 0 | 0 | 103 | 2815 | 9 | 796 | 2.57 | 7.0 | Yes | ○ |
| 129 | | 75.6 | 8.4 | 9.0 | 7.0 | 0 | 0 | 0 | 52 | 2731 | −2 | 778 | 2.25 | 7.5 | Yes | ○ |
| 130 | | 74.3 | 8.2 | 7.5 | 10.0 | 0 | 0 | 0 | 152 | 2947 | 6 | 774 | 2.66 | 5.4 | Yes | ○ |
| 131 | | 72.9 | 8.1 | 9.0 | 10.0 | 0 | 0 | 0 | 70 | 2817 | 6 | 818 | 2.82 | 4.5 | Yes | ○ |
| 132 | | 69.8 | 7.7 | 7.5 | 15.0 | 0 | 0 | 0 | 390 | 3119 | 20 | 848 | 2.17 | 4.4 | No | X |
| 133 | | 78.8 | 8.7 | 7.5 | 0 | 5.0 | 0 | 0 | 688 | 2828 | 5 | 689 | 2.47 | 6.7 | Yes | ○ |
| 134 | | 77.4 | 8.6 | 9.0 | 0 | 5.0 | 0 | 0 | 510 | 2746 | −3 | 708 | 2.13 | 8.2 | Yes | ○ |
| 135 | | 75.2 | 8.3 | 6.5 | 0 | 10.0 | 0 | 0 | 3962 | 3150 | 8 | 727 | 2.18 | 12.0 | Yes | ○ |
| 136 | | 70.7 | 7.8 | 6.5 | 0 | 15.0 | 0 | 0 | 8919 | 3284 | 16 | 767 | 1.77 | 15.1 | No | X |
| 137 | | 69.8 | 7.7 | 7.5 | 0 | 15.0 | 0 | 0 | 3452 | 3112 | 34 | 719 | 1.5 | 15.3 | No | X |
| 138 | | 78.8 | 8.7 | 7.5 | 0 | 0 | 5.0 | 0 | 491 | 3022 | −1 | 659 | 2.70 | 8.0 | Yes | ○ |
| 139 | | 77.4 | 8.6 | 9.0 | 0 | 0 | 5.0 | 0 | 330 | 2939 | −7 | 677 | 2.16 | 8.5 | Yes | ○ |
| 140 | | 75.6 | 8.4 | 6.0 | 0 | 0 | 10.0 | 0 | 615 | 3150 | −3 | 677 | 3.23 | 13.1 | Yes | ○ |
| 141 | | 74.3 | 8.2 | 7.5 | 0 | 0 | 10.0 | 0 | 356 | 3049 | 1 | 664 | 2.72 | 14.3 | Yes | ○ |
| 142 | | 71.1 | 7.9 | 6.0 | 0 | 0 | 15.0 | 0 | 406 | 3146 | 2 | 680 | 2.53 | 11.1 | Yes | ○ |
| 143 | | 69.8 | 7.7 | 7.5 | 0 | 0 | 15.0 | 0 | 210 | 3082 | 5 | 684 | 2.85 | 11.2 | Yes | ○ |
| 144 | | 78.8 | 8.7 | 7.5 | 0 | 0 | 0 | 5.0 | 964 | 2888 | 6 | 619 | 3.03 | 15.3 | Yes | ○ |
| 145 | | 77.4 | 8.6 | 9.0 | 0 | 0 | 0 | 5.0 | 574 | 2851 | 7 | 631 | 2.96 | 12.4 | Yes | ○ |
| 146 | | 74.3 | 8.2 | 7.5 | 0 | 0 | 0 | 10.0 | 4058 | 3182 | 46 | 626 | 2.35 | 15.5 | No | X |
| 147 | 96/4 | 80.6 | 3.4 | 11.0 | 5.0 | 0 | 0 | 0 | 954 | 2706 | −6 | 701 | 2.23 | 8.8 | Yes | ○ |

As shown in Table 3, among all samples of NTC thermistors, composition Nos. 123 and 124 have an atomic (manganese content)/(nickel content) ratio of 85/15, which is less than 87/13, and thus the second phase having a high electrical resistance, i.e., plate crystals mainly composed of manganese oxide, was not observed. Composition Nos. 125 to 146 having an atomic ratio of 90/10 and composition No. 147 having an atomic ratio of 96/4 satisfy the range of 87/13 or more and 96/4 or less. When these samples contained 15 at % or less copper, and 10 at % or less aluminum, 10 at % or less iron, 15 at % or less cobalt, or 5 at % or less titanium, dispersion of plate-shaped manganese oxide crystals serving as the second phase having a high electrical resistance was confirmed in the first phase, i.e., the matrix having a low electrical resistance. Thus, not only the electrical current concentration in the first phase is moderated and fracture caused by heat melting is suppressed but also the hardness or fracture toughness of the NTC thermistor ceramic can be enhanced. Thus, fracture attributable to cracks can be suppressed, and the voltage resistance can be improved as a result.

Example 2B

Green sheets obtained in EXAMPLE 2A were punched out or cut into a particular size, and internal electrode pattern layers were formed on a predetermined number of sheets by a screen printing method. The electrode-forming paste used to form the internal electrode pattern layers could be a conductive paste mainly composed of a noble metal, such as silver, silver-palladium, gold, platinum, or the like, or a base metal, such as nickel. In this example, a silver-palladium conductive paste with a silver/palladium content ratio of 3/7 was used.

The green sheets with the internal electrode pattern layers formed thereon were stacked so that the internal electrode pattern layers were alternately exposed, and green sheets with no internal electrode pattern layers were provided as the outermost layers. The resulting green sheets were pressed to form a multilayer green sheet compact.

The compact was fired as in EXAMPLE 1A to form a ceramic element body which was the constitutional component of the NTC thermistor of the present invention.

Subsequently, the outer shape of the ceramic element body was finished by barrel polishing, and an external electrode-forming paste was applied on two side faces of the ceramic element body. The electrode-forming paste used could be a paste mainly composed of a noble metal, such as silver, silver-palladium, gold, platinum, or the like. In this example, a silver paste was used. The silver paste was applied and baked at 700° C. to 850° C. to form the external electrodes. Finally, nickel and tin were plated on the surfaces of the external electrodes to prepare a multilayer NTC thermistor.

Figure 3:
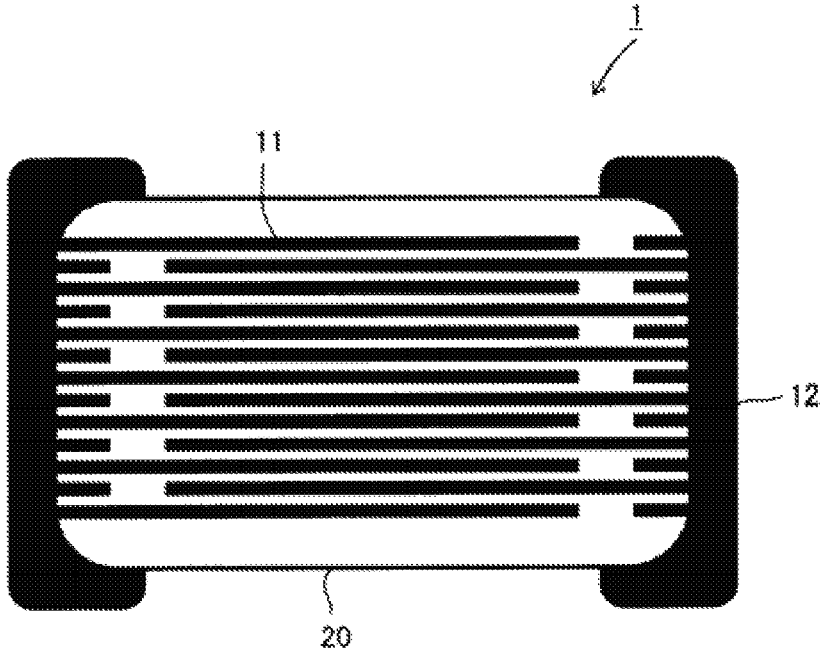
FIG. 3 is a cross-sectional view showing a structure of a multilayer NTC thermistor prepared in EXAMPLES.

FIG. 3 is a cross-sectional view showing the structure of the multilayer NTC thermistor prepared in the above-described example. As shown in FIG. 3, the NTC thermistor 1 includes internal electrode layers 11 inside the thermistor, external electrode layers 12 outside the thermistor, and a ceramic element body 20 serving as a base material. In the example described above, thirteen internal electrode layers 11 were stacked, and the distance between the internal electrode layers 11 was set to 130 μm. Although the dimensions of the NTC thermistor may vary, in this example, NTC thermistors of 3225 size (L: 3.2 mm×W: 2.5 mm×T: 1.6 mm) were prepared and evaluated.

In this example of the multilayer NTC thermistor shown in FIG. 3, the weight ratio of silver to palladium contained in the internal electrodes was 30:70, but the ratio is preferably 0:100 to 60:40. In this manner, the coverage of the internal electrodes can be enhanced in preparing the ceramic element body containing the internal electrodes by co-firing. Thus, the electrical field concentration on the internal electrodes can be prevented, and the voltage resistance of the multilayer NTC thermistor can be further improved.

The voltage resistance was evaluated by supplying inrush current to the multilayer NTC thermistor. The changes in electrical resistance after application of inrush current and the rate of change in electrical resistance ΔR25 were measured and calculated as in EXAMPLE 1B. From composition Nos. 126, 137, 139, and 145 in Table 3, multilayer NTC thermistors were prepared and inrush current was varied to measure changes in electrical resistance at that inrush current value and to calculate the rate of change in electrical resistance ΔR25. For comparative examination, multilayer NTC thermistors were prepared from composition Nos. 109 and 116 in Table 2, and the rate of change in electrical resistance ΔR25 at various inrush current values was calculated in the same fashion. The results are shown in Table 4.

Figure 4:
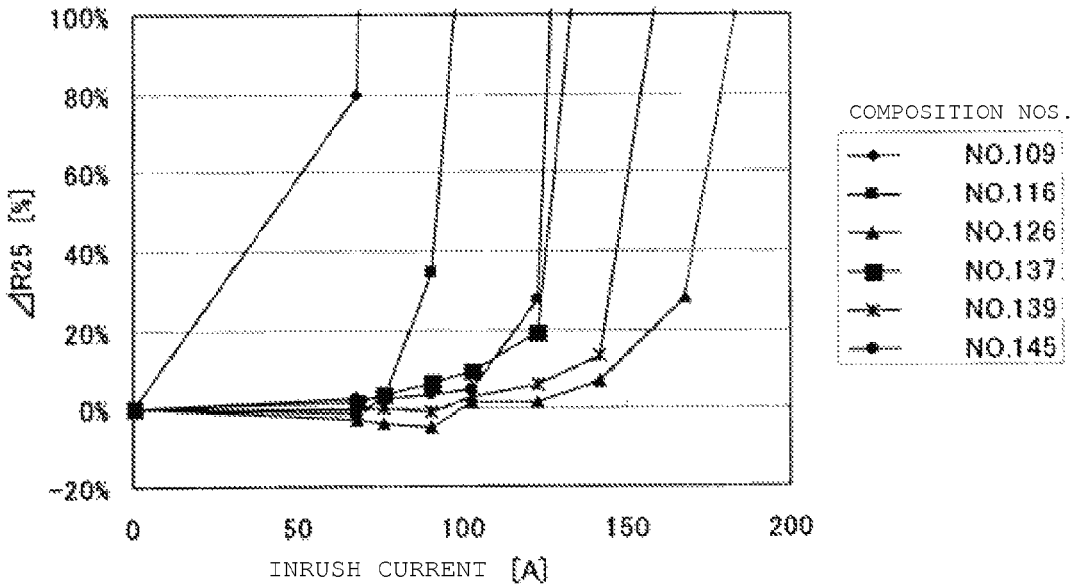
FIG. 4 is a graph showing the relationship between the inrush current value and rate of change in electrical resistance ΔR25 of multilayer NTC thermistors prepared from several compositions of EXAMPLES 1B and 2A.

FIG. 4 shows that compared to composition No. 109 in which plate crystals serving as the second phase having a high electrical resistance were not produced, composition No. 116 in which plate crystals serving as the second phase were produced exhibited high voltage resistance. Composition Nos. 126, 137, 139, and 145 having not only the second phase with a high resistance but also a high hardness or a high fracture toughness did not undergo changes in electrical resistance until an inrush current value higher than that for composition No. 116 having the second phase is reached, and thus show that they can improve the voltage resistance.

Example 3A

Manganese oxide ($Mn_3O_4$), cobalt oxide ($CO_3O_4$), copper oxide (CuO), aluminum oxide ($Al_2O_3$), iron oxide ($Fe_2O_3$), and nickel oxide (NiO), were weighed and blended so that the atomic ratios (atom %) of manganese (Mn), cobalt (Co), copper (Cu), aluminum (Al), iron (Fe), and nickel (Ni) after firing were adjusted to ratios shown in Tables 4 and 5. Then green sheets were prepared as in EXAMPLE 1A.

The resulting green sheets were stacked, pressed, and fired as in EXAMPLE 1A to prepare a ceramic element body serving as the NTC thermistor ceramic of the present invention. Electrodes were formed on the ceramic main body as in EXAMPLE 1A to obtain a single plate-type NTC thermistor.

The electrical characteristics, voltage resistance, and reliability of each sample of the single plate-type NTC thermistor were evaluated as in Example 1B. The results are shown in Tables 4 and 5.

TABLE 4

| Composition No. | Mn/Co ratio | Mn atom % | Co atom % | Cu atom % | Al atom % | Fe atom % | Ni atom % | Electrical characteristics ρ25 Ωcm | Electrical characteristics B25/50 K | ΔR25% after application of inrush current | Plate crystal | Judgment |
|---|---|---|---|---|---|---|---|---|---|---|---|---|
| 201 | 25/75 | 24.6 | 73.9 | 1.5 | — | — | — | 434 | 3839 | 33 | No | X |
| 202 | | 24.3 | 72.7 | 3.0 | — | — | — | 347 | 3753 | 58 | No | X |
| 203 | | 23.5 | 70.5 | 6.0 | — | — | — | 228 | 3577 | 20 | No | X |
| 204 | 35/65 | 34.5 | 64.0 | 1.5 | — | — | — | 193 | 3840 | 57 | No | X |
| 205 | | 34.0 | 63.0 | 3.0 | — | — | — | 135 | 3664 | 40 | No | X |
| 206 | | 32.9 | 61.1 | 6.0 | — | — | — | 133 | 3493 | 92 | No | X |
| 207 | 45/55 | 44.3 | 54.2 | 1.5 | — | — | — | 197 | 3908 | 71 | No | X |
| 208 | | 43.7 | 53.3 | 3.0 | — | — | — | 128 | 3694 | 20 | No | X |
| 209 | | 42.3 | 51.7 | 6.0 | — | — | — | 62 | 3432 | 130 | No | X |
| 210 | | 40.5 | 49.5 | 5.0 | 5.0 | — | — | 151 | 3626 | 27 | No | X |
| 211 | | 38.3 | 46.7 | 8.0 | 7.0 | — | — | 90 | 3427 | 67 | No | X |
| 212 | | 34.7 | 42.3 | 12.0 | 11.0 | — | — | 81 | 3303 | 39 | No | X |
| 213 | | 40.1 | 48.9 | 6.0 | — | 5.0 | — | 89 | 3417 | 60 | No | X |
| 214 | | 36.9 | 45.1 | 8.0 | — | 10.0 | — | 77 | 3283 | 41 | No | X |
| 215 | | 34.7 | 42.3 | 8.0 | — | 15.0 | — | 97 | 3216 | 54 | No | X |
| 216 | 60/40 | 57.0 | 38.0 | 5.0 | — | — | — | 453 | 3684 | 6 | Yes | ○ |
| 217 | | 55.8 | 37.2 | 7.0 | — | — | — | 181 | 3421 | 7 | Yes | ○ |
| 218 | | 54.0 | 36.0 | 5.0 | 5.0 | — | — | 289 | 3522 | 3 | Yes | ○ |
| 219 | | 52.8 | 35.2 | 7.0 | 5.0 | — | — | 118 | 3279 | 4 | Yes | ○ |
| 220 | | 51.0 | 34.0 | 10.0 | 5.0 | — | — | 45 | 2950 | 2 | Yes | ○ |
| 221 | | 48.0 | 32.0 | 15.0 | 5.0 | — | — | 23 | 2747 | 5 | Yes | ○ |
| 222 | | 49.8 | 33.2 | 7.0 | 10.0 | — | — | 93 | 3391 | 4 | Yes | ○ |
| 223 | | 46.8 | 31.2 | 7.0 | 15.0 | — | — | 42 | 3204 | 1 | Yes | ○ |
| 224 | | 43.8 | 29.2 | 7.0 | 20.0 | — | — | 130 | 3489 | 36 | No | X |
| 225 | | 54.0 | 36.0 | 5.0 | — | 5.0 | — | 454 | 3535 | 2 | Yes | ○ |
| 226 | | 52.8 | 35.2 | 7.0 | — | 5.0 | — | 150 | 3284 | 1 | Yes | ○ |
| 227 | | 49.8 | 33.2 | 7.0 | — | 10.0 | — | 332 | 3429 | 3 | Yes | ○ |
| 228 | | 46.8 | 31.2 | 7.0 | — | 15.0 | — | 138 | 3307 | 5 | Yes | ○ |
| 229 | | 43.8 | 29.2 | 7.0 | — | 20.0 | — | 251 | 3496 | 42 | No | X |

TABLE 4-continued

| Composition No. | Mn/Co ratio | Mn atom % | Co atom % | Cu atom % | Al atom % | Fe atom % | Ni atom % | Electrical characteristics ρ25 Ωcm | Electrical characteristics B25/50 K | ΔR25% after application of inrush current | Plate crystal | Judgment |
|---|---|---|---|---|---|---|---|---|---|---|---|---|
| 230 | | 54.0 | 36.0 | 5.0 | — | — | 5.0 | 87 | 3279 | 4 | Yes | ○ |
| 231 | | 52.8 | 35.2 | 7.0 | — | — | 5.0 | 46 | 3148 | 4 | Yes | ○ |
| 232 | | 49.8 | 33.2 | 7.0 | — | — | 10.0 | 38 | 2998 | 3 | Yes | ○ |
| 233 | | 46.8 | 31.2 | 7.0 | — | — | 15.0 | 36 | 2851 | 5 | Yes | ○ |
| 234 | | 43.8 | 29.2 | 7.0 | — | — | 20.0 | 63 | 2974 | 29 | No | X |
| 235 | 70/30 | 63.0 | 27.0 | 10.0 | — | — | — | 290 | 3250 | 7 | Yes | ○ |
| 236 | | 60.9 | 26.1 | 8.0 | 5.0 | — | — | 640 | 3405 | 4 | Yes | ○ |
| 237 | | 59.5 | 25.5 | 10.0 | 5.0 | — | — | 283 | 3194 | 3 | Yes | ○ |

TABLE 5

| Composition No. | Mn/Co ratio | Mn atom % | Co atom % | Cu atom % | Al atom % | Fe atom % | Ni atom % | Electrical characteristics ρ25 Ωcm | Electrical characteristics B25/50 K | ΔR25% after application of inrush current | Plate crystal | Judgment |
|---|---|---|---|---|---|---|---|---|---|---|---|---|
| 238 | 80/20 | 66.6 | 16.7 | 16.7 | — | — | — | 129 | 2783 | 8 | Yes | ○ |
| 239 | | 66.8 | 16.7 | 11.5 | 5.0 | — | — | 523 | 3005 | 3 | Yes | ○ |
| 240 | | 64.8 | 16.2 | 14.0 | 5.0 | — | — | 294 | 2873 | 3 | Yes | ○ |
| 241 | | 62.8 | 15.7 | 11.5 | 10.0 | — | — | 358 | 2914 | 4 | Yes | ○ |
| 242 | | 60.8 | 15.2 | 14.0 | 10.0 | — | — | 86 | 2757 | 5 | Yes | ○ |
| 243 | | 58.8 | 14.7 | 11.5 | 15.0 | — | — | 121 | 2795 | 2 | Yes | ○ |
| 244 | | 54.8 | 13.7 | 11.5 | 20.0 | — | — | 280 | 3102 | 18 | No | X |
| 245 | | 66.8 | 16.7 | 11.5 | — | 5.0 | — | 682 | 3019 | 2 | Yes | ○ |
| 246 | | 62.8 | 15.7 | 11.5 | — | 10.0 | — | 342 | 2936 | 4 | Yes | ○ |
| 247 | | 58.8 | 14.7 | 11.5 | — | 15.0 | — | 190 | 2864 | 1 | Yes | ○ |
| 248 | | 54.8 | 13.7 | 11.5 | — | 20.0 | — | 532 | 2971 | 25 | No | X |
| 249 | | 66.8 | 16.7 | 11.5 | — | — | 5.0 | 157 | 2759 | 3 | Yes | ○ |
| 250 | | 62.8 | 15.7 | 11.5 | — | — | 10.0 | 113 | 2710 | 4 | Yes | ○ |
| 251 | | 58.8 | 14.7 | 11.5 | — | — | 15.0 | 53 | 2657 | 6 | Yes | ○ |
| 252 | | 54.8 | 13.7 | 11.5 | — | — | 20.0 | 69 | 2639 | 21 | No | X |
| 253 | 90/10 | 70.2 | 7.8 | 22.0 | — | — | — | 312 | 2512 | 7 | Yes | ○ |
| 254 | | 70.2 | 7.8 | 17.0 | 5.0 | — | — | 217 | 2758 | 1 | Yes | ○ |
| 255 | | 65.7 | 7.3 | 22.0 | 5.0 | — | — | 47 | 2574 | 4 | Yes | ○ |
| 256 | | 61.2 | 6.8 | 22.0 | 10.0 | — | — | 36 | 2566 | 3 | Yes | ○ |
| 257 | | 56.7 | 6.3 | 22.0 | 15.0 | — | — | 22 | 2503 | 5 | Yes | ○ |
| 258 | | 52.2 | 5.8 | 22.0 | 20.0 | — | — | 33 | 2597 | 34 | No | X |
| 259 | | 65.7 | 7.3 | 22.0 | — | 5.0 | — | 74 | 2612 | 2 | Yes | ○ |
| 260 | | 61.2 | 6.8 | 22.0 | — | 10.0 | — | 52 | 2591 | 6 | Yes | ○ |
| 261 | | 56.7 | 6.3 | 22.0 | — | 15.0 | — | 29 | 2533 | 2 | Yes | ○ |
| 262 | | 52.2 | 5.8 | 22.0 | — | 20.0 | — | 47 | 2605 | 31 | No | X |
| 263 | | 65.7 | 7.3 | 22.0 | — | — | 5.0 | 24 | 2486 | 5 | Yes | ○ |
| 264 | | 61.2 | 6.8 | 22.0 | — | — | 10.0 | 20 | 2415 | 1 | Yes | ○ |
| 265 | | 56.7 | 6.3 | 22.0 | — | — | 15.0 | 25 | 2430 | 2 | Yes | ○ |
| 266 | | 52.2 | 5.8 | 22.0 | — | — | 20.0 | 30 | 2458 | 19 | No | X |
| 267 | 100/0 | 66.7 | — | 33.3 | — | — | — | 229 | 2889 | 24 | No | X |

As shown in Tables 4 and 5, plate crystals mainly composed of manganese oxide and serving as the second phase having a high electrical resistance were not found in NTC thermistor samples prepared from composition Nos. 201 to 215 having an atomic (manganese content)/(cobalt content) ratio less than 60/40. For composition Nos. 216 to 266, when the atomic ratio is 60/40 or more and 90/10 or less, 22 at % or less copper is present, and 15 at % or less of aluminum, iron, or nickel is present, dispersion of plate crystals mainly composed of manganese oxide serving as the second phase having a high electrical resistance was observed in the first phase serving as the matrix having a low electrical resistance. Thus, not only the electrical current concentration on the first phase is moderated and fracture caused by heat melting is suppressed but also the hardness or fracture toughness of the NTC thermistor ceramic can be enhanced. Thus, fracture attributable to cracks can be suppressed, and voltage resistance can be improved as a result.

Example 3B

Green sheets obtained in EXAMPLE 3A were used to prepare a multilayer NTC thermistor shown in FIG. 3 as in EXAMPLE 2B.

The voltage resistance was evaluated by supplying inrush current to the multilayer NTC thermistor. The changes in electrical resistance after application of inrush current and the rate of change in electrical resistance ΔR25 were measured and calculated as in EXAMPLE 1B. From composition Nos. 210, 238, 242, 246, and 250 shown in Tables 4 and 5, multilayer NTC thermistors were prepared, and the inrush current value was varied to measure changes in electrical resistance at the inrush current value and to calculate the rate of change in electrical resistance ΔR25. The results are shown in FIG. 5.

Figure 5:
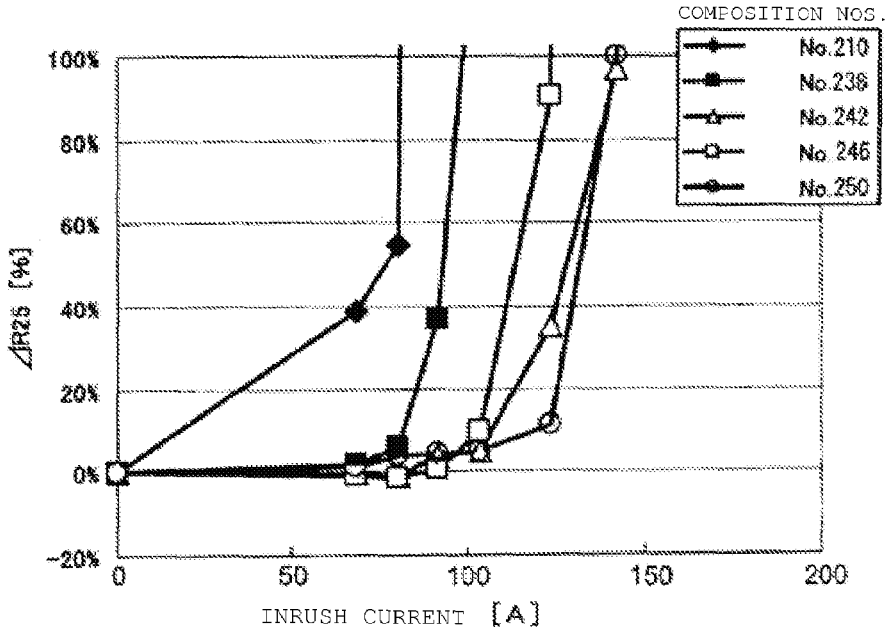
FIG. 5 is a graph showing the relationship between the inrush current value and rate of change in electrical resistance ΔR25 of multilayer NTC thermistors prepared from several compositions of EXAMPLE 3A.

FIG. 5 shows that compared to composition No. 210 in which plate crystals serving as the second phase having a high electrical resistance were not generated, composition No. 238 having the second phase generated therein shows high voltage resistance. Composition Nos. 242, 246, and 250 having not only the second phase generated therein but also a high hardness or a high fracture toughness did not undergo changes in electrical resistance until an inrush current value higher than that for composition No. 238 having the second phase is reached, and thus show that they can improve the voltage resistance.

Example 4A

Manganese oxide ($Mn_3O_4$), nickel oxide (NiO), copper oxide (CuO), aluminum oxide ($Al_2O_3$), iron oxide, cobalt oxide ($CO_3O_4$), titanium oxide ($TiO_2$), and zirconium oxide ($ZrO_2$) were weighed and blended so that the atomic ratios (atom %) of manganese (Mn), nickel (Ni), copper (Cu), aluminum (Al), iron (Fe), cobalt (Co), titanium (Ti), and zirconium (Zr) after firing were adjusted to ratios shown in Table 7. Then green sheets were prepared as in EXAMPLE 1A.

The resulting green sheets were stacked, pressed, and fired as in EXAMPLE 1A to prepare a ceramic element body as the NTC thermistor ceramic of the present invention. Electrodes were formed on the ceramic main body as in EXAMPLE 1A to obtain a single plate-type NTC thermistor.

The electrical characteristics, voltage resistance, and reliability of each sample of the single plate-type NTC thermistor were evaluated as in Example 1B. The results are shown in Tables 6 and 7.

TABLE 6

| Composition No. | Mn/Ni ratio | Feed amounts of raw materials: Mn atom % | Ni atom % | Cu atom % | Al atom % | Fe atom % | Co atom % | Ti atom % | Zr atom % | Electrical characteristics: ρ25 Ωcm | B25/50 K | Voltage resistance ΔR25% after application of inrush current | Vickers hardness: Hv | Klc MN/m1.5 | Reliability ΔR25% | Plate crystal | Judgment |
|---|---|---|---|---|---|---|---|---|---|---|---|---|---|---|---|---|---|
| 301 | 87/13 | 74.0 | 11.0 | 15.0 | — | — | — | — | 0.0 | 102 | 2766 | 4 | 684 | 2.55 | 12.3 | Yes | ○ |
| 302 | | 73.8 | 11.0 | 15.0 | — | — | — | — | 0.2 | 115 | 2791 | 4 | 677 | 2.50 | 16.3 | Yes | ○ |
| 303 | | 73.1 | 10.9 | 15.0 | — | — | — | — | 1.0 | 106 | 2755 | −2 | 661 | 2.42 | 17.3 | Yes | ○ |
| 304 | | 72.6 | 10.9 | 15.0 | — | — | — | — | 1.5 | 97 | 2743 | 3 | 679 | 2.68 | 13.9 | Yes | ○ |
| 305 | | 71.3 | 10.7 | 15.0 | — | — | — | — | 3.0 | 83 | 2698 | 79 | 603 | 1.94 | 18.2 | Yes | X |
| 306 | 90/10 | 80.1 | 8.9 | 11.0 | — | — | — | — | 0.0 | 152 | 2760 | 2 | 680 | 2.54 | 14.0 | Yes | ○ |
| 307 | | 79.9 | 8.9 | 11.0 | — | — | — | — | 0.2 | 163 | 2739 | 2 | 642 | 2.35 | 17.5 | Yes | ○ |
| 308 | | 79.7 | 8.9 | 11.0 | — | — | — | — | 0.4 | 175 | 2779 | 1 | 667 | 2.52 | 16.0 | Yes | ○ |
| 309 | | 79.6 | 8.8 | 11.0 | — | — | — | — | 0.6 | 147 | 2757 | −2 | 669 | 2.53 | 18.0 | Yes | ○ |
| 310 | | 79.2 | 8.8 | 11.0 | — | — | — | — | 1.0 | 120 | 2733 | 0 | 674 | 2.68 | 18.3 | Yes | ○ |
| 311 | | 78.8 | 8.7 | 11.0 | — | — | — | — | 1.5 | 91 | 2719 | 1 | 650 | 2.35 | 17.5 | Yes | ○ |
| 312 | | 77.4 | 8.6 | 11.0 | — | — | — | — | 3.0 | 66 | 2694 | 62 | 575 | 2.09 | 16.2 | Yes | X |
| 313 | 96/4 | 81.6 | 3.4 | 15.0 | — | — | — | — | 0.0 | 513 | 2768 | 6 | 674 | 2.61 | 9.4 | Yes | ○ |
| 314 | | 81.4 | 3.4 | 15.0 | — | — | — | — | 0.2 | 553 | 2798 | 4 | 667 | 2.42 | 14.2 | Yes | ○ |
| 315 | | 80.6 | 3.4 | 15.0 | — | — | — | — | 1.0 | 540 | 2743 | 1 | 638 | 2.49 | 12.7 | Yes | ○ |
| 316 | | 80.2 | 3.3 | 15.0 | — | — | — | — | 1.5 | 498 | 2755 | −3 | 652 | 2.71 | 17.3 | Yes | ○ |
| 317 | | 78.7 | 3.3 | 15.0 | — | — | — | — | 3.0 | 441 | 2684 | 44 | 595 | 2.05 | 16.5 | Yes | X |

TABLE 7

| Composition No. | Mn/Ni ratio | Feed amounts of raw materials: Mn atom % | Ni atom % | Cu atom % | Al atom % | Fe atom % | Co atom % | Ti atom % | Zr atom % | Electrical characteristics: ρ25 Ωcm | B25/50 K | Voltage resistance ΔR25% after application of inrush current | Vickers hardness: Hv | Klc MN/m1.5 | Reliability ΔR25% | Plate crystal | Judgment |
|---|---|---|---|---|---|---|---|---|---|---|---|---|---|---|---|---|---|
| 318 | 90/10 | 78.8 | 8.7 | 7.5 | 5.0 | — | — | — | 0.0 | 300 | 2900 | 0 | 753 | 2.61 | 10.6 | Yes | ○ |
| 319 | | 78.6 | 8.7 | 7.5 | 5.0 | — | — | — | 0.2 | 360 | 2909 | −1 | 700 | 2.53 | 14.0 | Yes | ○ |
| 320 | | 77.9 | 8.6 | 7.5 | 5.0 | — | — | — | 1.0 | 300 | 2867 | 2 | 669 | 2.37 | 16.2 | Yes | ○ |
| 321 | | 77.4 | 8.6 | 7.5 | 5.0 | — | — | — | 1.5 | 318 | 2875 | 2 | 631 | 2.61 | 16.4 | Yes | ○ |
| 322 | | 76.0 | 8.5 | 7.5 | 5.0 | — | — | — | 3.0 | 246 | 2812 | 63 | 531 | 2.01 | 15.7 | Yes | X |
| 323 | 90/10 | 77.4 | 8.6 | 9.0 | — | 5.0 | — | — | 0.0 | 510 | 2746 | −3 | 708 | 2.13 | 8.2 | Yes | ○ |
| 324 | | 77.2 | 8.6 | 9.0 | — | 5.0 | — | — | 0.2 | 505 | 2751 | −1 | 679 | 2.26 | 12.3 | Yes | ○ |
| 325 | | 76.5 | 8.5 | 9.0 | — | 5.0 | — | — | 1.0 | 523 | 2705 | 3 | 653 | 2.13 | 14.8 | Yes | ○ |
| 326 | | 76.1 | 8.4 | 9.0 | — | 5.0 | — | — | 1.5 | 516 | 2716 | −2 | 641 | 2.06 | 13.4 | Yes | ○ |
| 327 | | 74.7 | 8.3 | 9.0 | — | 5.0 | — | — | 3.0 | 467 | 2668 | 41 | 588 | 1.86 | 12.8 | Yes | X |
| 328 | 90/10 | 77.4 | 8.6 | 9.0 | — | — | 5.0 | — | 0.0 | 330 | 2939 | −7 | 677 | 2.16 | 8.5 | Yes | ○ |
| 329 | | 77.2 | 8.6 | 9.0 | — | — | 5.0 | — | 0.2 | 341 | 2910 | 2 | 667 | 2.52 | 14.6 | Yes | ○ |
| 330 | | 76.5 | 8.5 | 9.0 | — | — | 5.0 | — | 1.0 | 332 | 2904 | −4 | 687 | 2.08 | 14.2 | Yes | ○ |
| 331 | | 76.1 | 8.4 | 9.0 | — | — | 5.0 | — | 1.5 | 322 | 2883 | 5 | 618 | 2.00 | 12.6 | Yes | ○ |
| 332 | | 74.7 | 8.3 | 9.0 | — | — | 5.0 | — | 3.0 | 284 | 2840 | 59 | 546 | 1.87 | 17.6 | Yes | X |
| 333 | 90/10 | 77.4 | 8.6 | 9.0 | — | — | — | 5.0 | 0.0 | 574 | 2851 | 7 | 631 | 2.96 | 12.4 | Yes | ○ |
| 334 | | 77.2 | 8.6 | 9.0 | — | — | — | 5.0 | 0.2 | 551 | 2846 | 3 | 639 | 2.45 | 17.4 | Yes | ○ |
| 335 | | 76.5 | 8.5 | 9.0 | — | — | — | 5.0 | 1.0 | 565 | 2823 | 4 | 624 | 2.23 | 16.7 | Yes | ○ |

TABLE 7-continued

| Composition No. | Mn/Ni ratio | Feed amounts of raw materials: Mn atom % | Ni atom % | Cu atom % | Al atom % | Fe atom % | Co atom % | Ti atom % | Zr atom % | Electrical characteristics: ρ25 Ωcm | B25/50 K | Voltage resistance ΔR25% after application of inrush current | Vickers hardness: Hv | Klc MN/m1.5 | Reliability ΔR25% | Plate crystal | Judgment |
|---|---|---|---|---|---|---|---|---|---|---|---|---|---|---|---|---|---|
| 336 | | 76.1 | 8.4 | 9.0 | — | — | — | 5.0 | 1.5 | 542 | 2796 | 4 | 615 | 2.10 | 14.9 | Yes | ○ |
| 337 | | 74.7 | 8.3 | 9.0 | — | — | — | 5.0 | 3.0 | 512 | 2749 | 31 | 566 | 1.89 | 18.8 | Yes | X |

Tables 6 and 7 show that among all samples of NTC thermistors, composition Nos. 301 to 337, dispersion of plate crystals mainly composed of manganese oxide serving as the second phase having a high electrical resistance was observed in the first phase serving as the matrix having a high electrical resistance when the atomic (manganese content)/(nickel content) ratio was 87/13 or more and 96/4 or less, 15 at % or less copper was present, at least one of 10 at % or less aluminum, 10 at % or less iron, 15 at % or less cobalt, and 5 at % or less titanium was present, and 1.5 at % or less zirconium was contained. Thus, not only the electrical current concentration on the first phase is moderated and fracture caused by heat melting is suppressed but also the hardness or fracture toughness of the NTC thermistor ceramic can be enhanced. Thus, fracture attributable to cracks can be suppressed. Since segregation of zirconium oxide in the ceramic grain boundaries is observed, the hardness or fracture toughness of the NTC thermistor ceramic can be substantially retained at a high value, and thus the voltage resistance can be enhanced.

At a zirconium content exceeding 1.5 at %, e.g., 3 at %, the voltage resistance deteriorated. This is presumably because when a large amount of zirconium is present, the zirconium inhibits sinterability of the ceramic and increases the pore ratio in the ceramic element body.

Example 4B

Green sheets obtained in EXAMPLE 4A were used to prepare a multilayer NTC thermistor shown in FIG. 3 as in EXAMPLE 2B.

The voltage resistance was evaluated by supplying inrush current to the multilayer NTC thermistor. The changes in electrical resistance after application of inrush current and the rate of change in electrical resistance ΔR25 were measured and calculated as in EXAMPLE 1. From composition Nos. 306, 307, 310, 318, 319, 320, 323, 324, 325, 328, 329, 330, 333, 334, and 335 shown in Tables 6 and 7, multilayer NTC thermistors were prepared, and the inrush current value was varied to measure changes in electrical resistance at the inrush current value and to calculate the rate of change in electrical resistance ΔR25. The results are shown in FIGS. 6 to 10.

Figure 6:
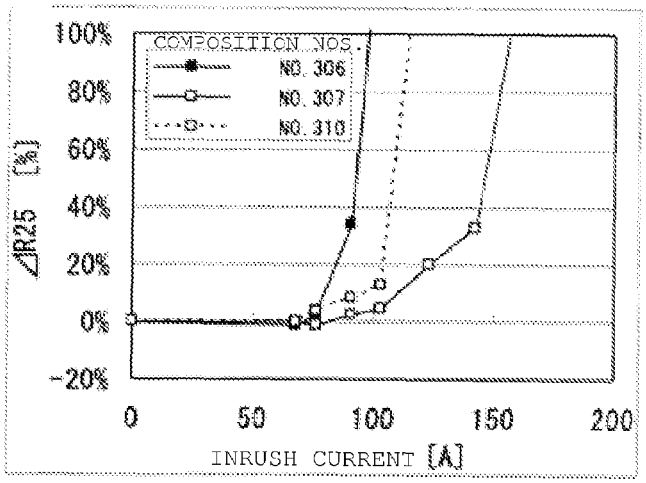
FIG. 6 is a graph showing the relationship between the inrush current value and rate of change in electrical resistance ΔR25 of multilayer NTC thermistors prepared from several compositions of EXAMPLE 4A.

FIG. 6 shows that composition Nos. 307 and 310 containing 1.5 at % or less zirconium do not undergo changes in electrical resistance until a relatively high inrush current value is reached when compared with composition No. 306 containing no zirconium but having a second phase exhibiting a high electrical resistance. This shows that adding zirconium can further increase voltage resistance.

Figure 7:
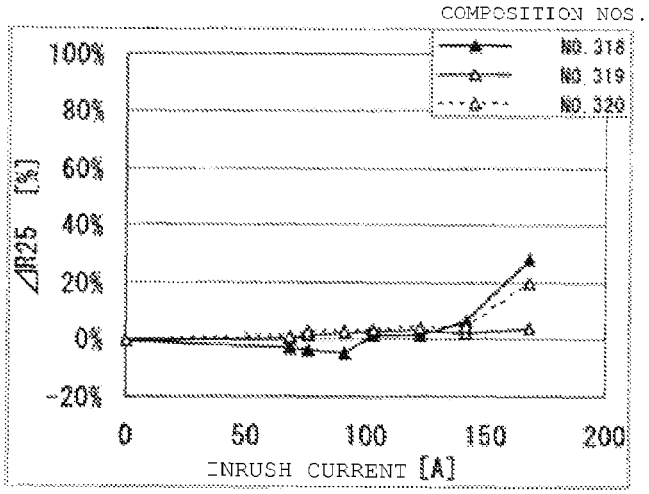
FIG. 7 is another graph showing the relationship between the inrush current value and rate of change in electrical resistance ΔR25 of multilayer NTC thermistors prepared from several compositions of EXAMPLE 4A.

Similarly, FIG. 7 shows that composition Nos. 319 and containing 1.5 at % or less zirconium do not undergo changes in electrical resistance until a relatively high inrush current value is reached when compared with composition No. 318 containing no zirconium but having a second phase exhibiting a high electrical resistance. This shows that adding zirconium can further increase voltage resistance.

Figure 8:
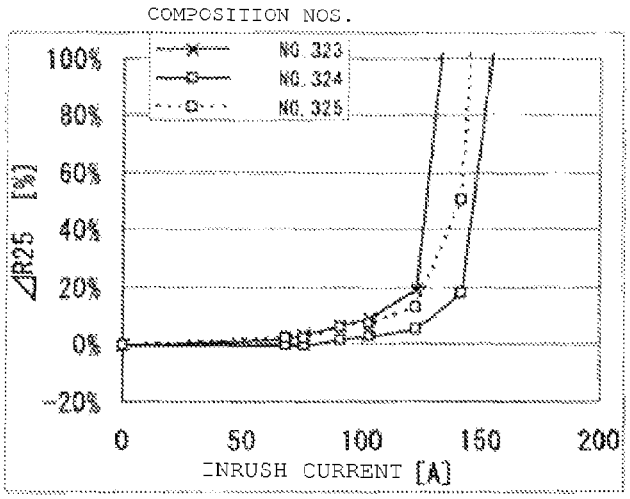
FIG. 8 is another graph showing the relationship between the inrush current value and rate of change in electrical resistance ΔR25 of multilayer NTC thermistors prepared from several compositions of EXAMPLE 4A.

Similarly, FIG. 8 shows that composition Nos. 324 and 325 containing 1.5 at % or less zirconium do not undergo changes in electrical resistance until a relatively high inrush current value is reached when compared with composition No. 323 containing no zirconium but having a second phase exhibiting a high electrical resistance. This shows that adding zirconium can further increase voltage resistance.

Figure 9:
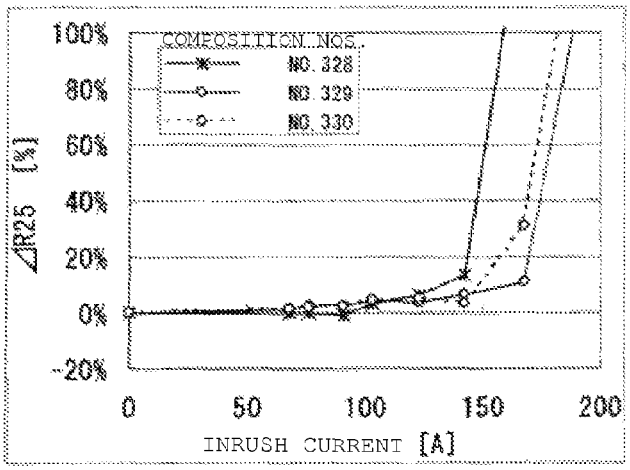
FIG. 9 is another graph showing the relationship between the inrush current value and rate of change in electrical resistance ΔR25 of multilayer NTC thermistors prepared from several compositions of EXAMPLE 4A.

Likewise, FIG. 9 shows that composition Nos. 329 and 330 containing 1.5 at % or less zirconium do not undergo changes in electrical resistance until a relatively high inrush current value is reached when compared with composition No. 328 containing no zirconium but having a second phase exhibiting a high electrical resistance. This shows that adding zirconium can further increase voltage resistance.

Figure 10:
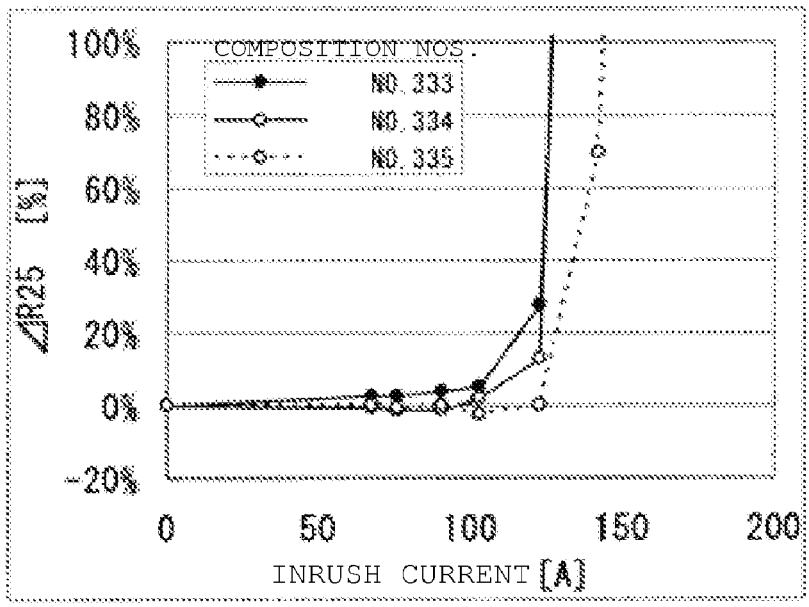
FIG. 10 is another graph showing the relationship between the inrush current value and rate of change in electrical resistance ΔR25 of multilayer NTC thermistors prepared from several compositions of EXAMPLE 4A.

Similarly, FIG. 10 shows that composition Nos. 334 and 335 containing 1.5 at % or less zirconium do not undergo changes in electrical resistance until a relatively high inrush current value is reached when compared with composition No. 333 containing no zirconium but having a second phase exhibiting a high electrical resistance. This shows that adding zirconium can further increase voltage resistance.

Example 5A

Manganese oxide ($Mn_3O_4$), nickel oxide (NiO), copper oxide (CuO), calcium carbonate ($CaCO_3$), aluminum oxide ($Al_2O_3$), iron oxide ($Fe_2O_3$), cobalt oxide ($CO_3O_4$), and titanium oxide ($TiO_2$) were weighed and blended so that the atomic ratios (atom %) of manganese (Mn), nickel (Ni), copper (Cu), calcium (Ca), aluminum (Al), iron (Fe), cobalt (Co), and titanium (Ti) after firing were adjusted to ratios shown in Tables 8 to 10. Then green sheets were prepared as in EXAMPLE 1A.

The resulting green sheets were stacked, pressed, and fired as in EXAMPLE 1A to prepare a ceramic element body as the NTC thermistor ceramic of the present invention. Electrodes were formed on the ceramic main body as in EXAMPLE 1A to obtain a single plate-type NTC thermistor.

The electrical characteristics, voltage resistance, and reliability of each sample of the single plate-type NTC thermistor were evaluated as in EXAMPLE 1. The results are shown in Tables 8 to 10.

TABLE 8

| Composition No. | Mn/Ni ratio | Feed amounts of raw materials: Mn atom % | Ni atom % | Cu atom % | Ca atom % | Electrical characteristics: ρ25 Ωcm | B25/50 K | Voltage resistance ΔR25% after application of inrush current | Plate crystal | Judgment |
|---|---|---|---|---|---|---|---|---|---|---|
| 401 | 85/15 | 85.0 | 15.0 | 0.0 | 0.0 | 3243 | 3694 | 61 | No | X |
| 402 | | 76.9 | 13.6 | 4.5 | 5.0 | 147 | 3283 | 55 | No | X |
| 403 | | 75.7 | 13.3 | 6.0 | 5.0 | 75 | 3055 | 37 | No | X |
| 404 | 87/13 | 87.0 | 13.0 | 0.0 | 0.0 | 17600 | 4215 | 2 | Yes | ○ |
| 405 | | 82.7 | 12.3 | 0.0 | 5.0 | 3961 | 4099 | 6 | Yes | ○ |
| 406 | | 78.3 | 11.7 | 0.0 | 10.0 | 3158 | 4085 | 4 | Yes | ○ |
| 407 | | 74.0 | 11.0 | 0.0 | 15.0 | 2257 | 3947 | 51 | No | X |
| 408 | | 78.3 | 11.7 | 10.0 | 0.0 | 337 | 3149 | 3 | Yes | ○ |
| 409 | | 74.0 | 11.0 | 10.0 | 5.0 | 123 | 2987 | 4 | Yes | ○ |
| 410 | | 69.6 | 10.4 | 10.0 | 10.0 | 98 | 2968 | 7 | Yes | ○ |
| 411 | | 65.2 | 9.8 | 10.0 | 15.0 | 57 | 2864 | 48 | No | X |
| 412 | | 74.0 | 11.0 | 15.0 | 0.0 | 102 | 2766 | 4 | Yes | ○ |
| 413 | | 69.6 | 10.4 | 15.0 | 5.0 | 42 | 2715 | 1 | Yes | ○ |
| 414 | | 65.2 | 9.8 | 15.0 | 10.0 | 33 | 2694 | 5 | Yes | ○ |
| 415 | | 60.9 | 9.1 | 15.0 | 15.0 | 21 | 2659 | 42 | No | X |
| 416 | 90/10 | 90.0 | 10.0 | 0.0 | 0.0 | 26890 | 4243 | 2 | Yes | ○ |
| 417 | | 85.5 | 9.5 | 0.0 | 5.0 | 6397 | 4056 | 5 | Yes | ○ |
| 418 | | 81.0 | 9.0 | 0.0 | 10.0 | 5008 | 3989 | 3 | Yes | ○ |
| 419 | | 76.5 | 8.5 | 0.0 | 15.0 | 3255 | 3874 | 24 | No | X |
| 420 | | 81.0 | 9.0 | 10.0 | 0.0 | 206 | 2805 | 3 | Yes | ○ |
| 421 | | 76.5 | 8.5 | 10.0 | 5.0 | 68 | 2798 | 2 | Yes | ○ |
| 422 | | 72.0 | 8.0 | 10.0 | 10.0 | 54 | 2769 | 3 | Yes | ○ |
| 423 | | 67.5 | 7.5 | 10.0 | 15.0 | 30 | 2755 | 17 | No | X |
| 424 | | 76.5 | 8.5 | 15.0 | 0.0 | 67 | 2809 | 7 | Yes | ○ |
| 425 | | 72.0 | 8.0 | 15.0 | 5.0 | 33 | 2802 | 3 | Yes | ○ |
| 426 | | 67.5 | 7.5 | 15.0 | 10.0 | 27 | 2769 | 5 | Yes | ○ |
| 427 | | 63.0 | 7.0 | 15.0 | 15.0 | 20 | 2775 | 36 | No | X |
| 428 | 96/4 | 96.0 | 4.0 | 0.0 | 0.0 | 269383 | 4583 | 5 | Yes | ○ |
| 429 | | 91.2 | 3.8 | 0.0 | 5.0 | 53861 | 4493 | 6 | Yes | ○ |
| 430 | | 86.4 | 3.6 | 0.0 | 10.0 | 40416 | 4386 | 1 | Yes | ○ |
| 431 | | 81.6 | 3.4 | 0.0 | 15.0 | 24250 | 4310 | 38 | No | X |
| 432 | | 86.4 | 3.6 | 10.0 | 0.0 | 1671 | 2952 | 6 | Yes | ○ |
| 433 | | 81.6 | 3.4 | 10.0 | 5.0 | 393 | 2846 | 4 | Yes | ○ |
| 434 | | 76.8 | 3.2 | 10.0 | 10.0 | 287 | 2812 | 4 | Yes | ○ |
| 435 | | 72.0 | 3.0 | 10.0 | 15.0 | 217 | 2779 | 45 | No | X |
| 436 | | 81.6 | 3.4 | 15.0 | 0.0 | 513 | 2768 | 6 | Yes | ○ |
| 437 | | 76.8 | 3.2 | 15.0 | 5.0 | 126 | 2733 | 6 | Yes | ○ |
| 438 | | 72.0 | 3.0 | 15.0 | 10.0 | 95 | 2685 | 4 | Yes | ○ |
| 439 | | 67.2 | 2.8 | 15.0 | 15.0 | 52 | 2691 | 31 | No | X |
| 440 | 100/0 | 66.7 | 0 | 33.3 | 5.0 | 210 | 2871 | 39 | No | X |

TABLE 9

| Composition No. | Mn/Ni ratio | Feed amounts of raw materials: Mn atom % | Ni atom % | Cu atom % | Al atom % | Fe atom % | Co atom % | Ti atom % | Ca atom % | Electrical characteristics: ρ25 Ωcm | B25/50 K | Voltage resistance ΔR25% after application of inrush current | Plate crystal | Judgment |
|---|---|---|---|---|---|---|---|---|---|---|---|---|---|---|
| 441 | 90/10 | 78.8 | 8.7 | 7.5 | 5 | 0 | 0 | 0 | 0 | 300 | 2900 | 0 | Yes | ○ |
| 442 | | 74.3 | 8.2 | 7.5 | 5 | 0 | 0 | 0 | 5 | 59 | 2807 | 4 | Yes | ○ |
| 443 | | 69.8 | 7.7 | 7.5 | 5 | 0 | 0 | 0 | 10 | 43 | 2798 | 2 | Yes | ○ |
| 444 | | 74.3 | 8.2 | 7.5 | 10 | 0 | 0 | 0 | 0 | 152 | 2947 | 6 | Yes | ○ |
| 445 | | 69.8 | 7.7 | 7.5 | 10 | 0 | 0 | 0 | 5 | 87 | 2856 | 3 | Yes | ○ |
| 446 | | 65.3 | 7.2 | 7.5 | 10 | 0 | 0 | 0 | 10 | 63 | 2814 | 4 | Yes | ○ |
| 447 | | 69.8 | 7.7 | 7.5 | 15 | 0 | 0 | 0 | 0 | 390 | 3119 | 20 | No | X |
| 448 | | 65.3 | 7.2 | 7.5 | 15 | 0 | 0 | 0 | 5 | 312 | 3096 | 25 | No | X |
| 449 | | 60.8 | 6.7 | 7.5 | 15 | 0 | 0 | 0 | 10 | 299 | 3088 | 62 | No | X |
| 450 | | 78.8 | 8.7 | 7.5 | 0 | 5 | 0 | 0 | 0 | 688 | 2828 | 5 | Yes | ○ |
| 451 | | 74.3 | 8.2 | 7.5 | 0 | 5 | 0 | 0 | 5 | 78 | 2745 | 8 | Yes | ○ |
| 452 | | 69.8 | 7.7 | 7.5 | 0 | 5 | 0 | 0 | 10 | 64 | 2719 | 4 | Yes | ○ |
| 453 | | 77.4 | 8.6 | 9.0 | 0 | 5 | 0 | 0 | 0 | 510 | 2746 | −3 | Yes | ○ |
| 454 | | 72.9 | 8.1 | 9.0 | 0 | 5 | 0 | 0 | 5 | 67 | 2722 | 3 | Yes | ○ |
| 455 | | 68.4 | 7.6 | 9.0 | 0 | 5 | 0 | 0 | 10 | 56 | 2713 | 4 | Yes | ○ |
| 456 | | 75.2 | 8.3 | 6.5 | 0 | 10 | 0 | 0 | 0 | 3962 | 3150 | 7 | Yes | ○ |
| 457 | | 70.7 | 7.8 | 6.5 | 0 | 10 | 0 | 0 | 5 | 279 | 3007 | 5 | Yes | ○ |
| 458 | | 66.2 | 7.3 | 6.5 | 0 | 10 | 0 | 0 | 10 | 318 | 2984 | 6 | Yes | ○ |

TABLE 9-continued

| Composition No. | Mn/Ni ratio | Feed amounts of raw materials: Mn atom % | Ni atom % | Cu atom % | Al atom % | Fe atom % | Co atom % | Ti atom % | Ca atom % | Electrical characteristics: ρ25 Ωcm | B25/50 K | Voltage resistance ΔR25% after application of inrush current | Plate crystal | Judgment |
|---|---|---|---|---|---|---|---|---|---|---|---|---|---|---|
| 459 | | 69.8 | 7.7 | 7.5 | 0 | 15 | 0 | 0 | 0 | 3452 | 3112 | 34 | No | X |
| 460 | | 65.3 | 7.2 | 7.5 | 0 | 15 | 0 | 0 | 5 | 354 | 3089 | 51 | No | X |
| 461 | | 60.8 | 6.7 | 7.5 | 0 | 15 | 0 | 0 | 10 | 303 | 3051 | 29 | No | X |

TABLE 10

| Composition No. | Mn/Ni ratio | Feed amounts of raw materials: Mn atom % | Ni atom % | Cu atom % | Al atom % | Fe atom % | Co atom % | Ti atom % | Ca atom % | Electrical characteristics: ρ25 Ωcm | B25/50 K | Voltage resistance ΔR25% after application of inrush current | Plate crystal | Judgment |
|---|---|---|---|---|---|---|---|---|---|---|---|---|---|---|
| 462 | 90/10 | 78.8 | 8.7 | 7.5 | 0 | 0 | 5 | 0 | 0 | 491 | 3022 | −1 | Yes | ○ |
| 463 | | 74.3 | 8.2 | 7.5 | 0 | 0 | 5 | 0 | 5 | 46 | 2729 | 4 | Yes | ○ |
| 464 | | 69.8 | 7.7 | 7.5 | 0 | 0 | 5 | 0 | 10 | 39 | 2741 | 1 | Yes | ○ |
| 465 | | 77.4 | 8.6 | 9.0 | 0 | 0 | 5 | 0 | 0 | 330 | 2939 | −7 | Yes | ○ |
| 466 | | 72.9 | 8.1 | 9.0 | 0 | 0 | 5 | 0 | 5 | 41 | 2736 | 2 | Yes | ○ |
| 467 | | 68.4 | 7.6 | 9.0 | 0 | 0 | 5 | 0 | 10 | 27 | 2711 | 3 | Yes | ○ |
| 468 | | 74.3 | 8.2 | 7.5 | 0 | 0 | 10 | 0 | 0 | 356 | 3049 | 1 | Yes | ○ |
| 469 | | 69.8 | 7.7 | 7.5 | 0 | 0 | 10 | 0 | 5 | 65 | 2834 | 5 | Yes | ○ |
| 470 | | 65.3 | 7.2 | 7.5 | 0 | 0 | 10 | 0 | 10 | 47 | 2814 | 3 | Yes | ○ |
| 471 | | 69.8 | 7.7 | 7.5 | 0 | 0 | 15 | 0 | 0 | 210 | 3082 | 5 | Yes | ○ |
| 472 | | 65.3 | 7.2 | 7.5 | 0 | 0 | 15 | 0 | 5 | 55 | 2918 | 4 | Yes | ○ |
| 473 | | 60.8 | 6.7 | 7.5 | 0 | 0 | 15 | 0 | 10 | 61 | 2895 | 2 | Yes | ○ |
| 474 | | 78.8 | 8.7 | 7.5 | 0 | 0 | 0 | 5 | 0 | 964 | 2888 | 6 | Yes | ○ |
| 475 | | 74.3 | 8.2 | 7.5 | 0 | 0 | 0 | 5 | 5 | 261 | 2816 | 5 | Yes | ○ |
| 476 | | 69.8 | 7.7 | 7.5 | 0 | 0 | 0 | 5 | 10 | 197 | 2784 | 4 | Yes | ○ |
| 477 | | 77.4 | 8.6 | 9.0 | 0 | 0 | 0 | 5 | 0 | 574 | 2851 | 7 | Yes | ○ |
| 478 | | 72.9 | 8.1 | 9.0 | 0 | 0 | 0 | 5 | 5 | 77 | 2815 | 3 | Yes | ○ |
| 479 | | 68.4 | 7.6 | 9.0 | 0 | 0 | 0 | 5 | 10 | 62 | 2809 | −5 | Yes | ○ |
| 480 | | 74.3 | 8.2 | 7.5 | 0 | 0 | 0 | 10 | 0 | 4058 | 3182 | 46 | No | X |
| 481 | | 69.8 | 7.7 | 7.5 | 0 | 0 | 0 | 10 | 5 | 415 | 2956 | 68 | No | X |
| 482 | | 65.3 | 7.2 | 7.5 | 0 | 0 | 0 | 10 | 10 | 351 | 2922 | 37 | No | X |

As shown in Table 8, among all samples of NTC thermistors, for composition Nos. 401 to 440, when the atomic (manganese content)/(nickel content) ratio is 87/13 or more and 96/4 or less, 15 at % or less copper is present, and 10 at % or less (excluding 0 at %) calcium is further present, not only plate crystals mainly composed manganese oxide serving as the second phase having a high electrical resistance but also $CaMn_2O_4$ or $CaMnO_3$ serving as a third phase having a high electrical resistance is dispersed in the first phase, i.e., the matrix having a low electrical resistance. Thus, the electrical current concentration on the first phase is moderated, fracture caused by heat melting is suppressed, and the voltage resistance can be improved further.

As shown in Tables 9 and 10, among all samples of NTC thermistors, for composition Nos. 441 to 482, when the atomic (manganese content)/(nickel content) ratio of 87/13 or more and 96/4 or less, 15 at % or less copper is present, and 10 at % or less aluminum, 10 at % or less iron, 15 at % or less cobalt, or 5 at % or less titanium is further present, and 10 at % or less (excluding 0 at %) calcium is yet further present, not only plate crystals mainly composed manganese oxide serving as the second phase having a high electrical resistance but also $CaMn_2O_4$ or $CaMnO_3$ serving as a third phase having a high electrical resistance is dispersed in the first phase, i.e., a matrix having a low electrical resistance. Thus, the electrical current concentration on the first phase is moderated, fracture caused by heat melting is suppressed, and the hardness or fracture toughness of the NTC thermistor ceramic can be increased. Thus, fracture attributable to cracks can be suppressed, and the voltage resistance can be improved further.

Next, composition No. 421 was analyzed with a scanning ion microscope (SIM) and a scanning transmission electron microscope (STEM) to observe ceramic grains and conduct energy dispersive X-ray fluorescent spectrometry (EDX).

Figure 22:
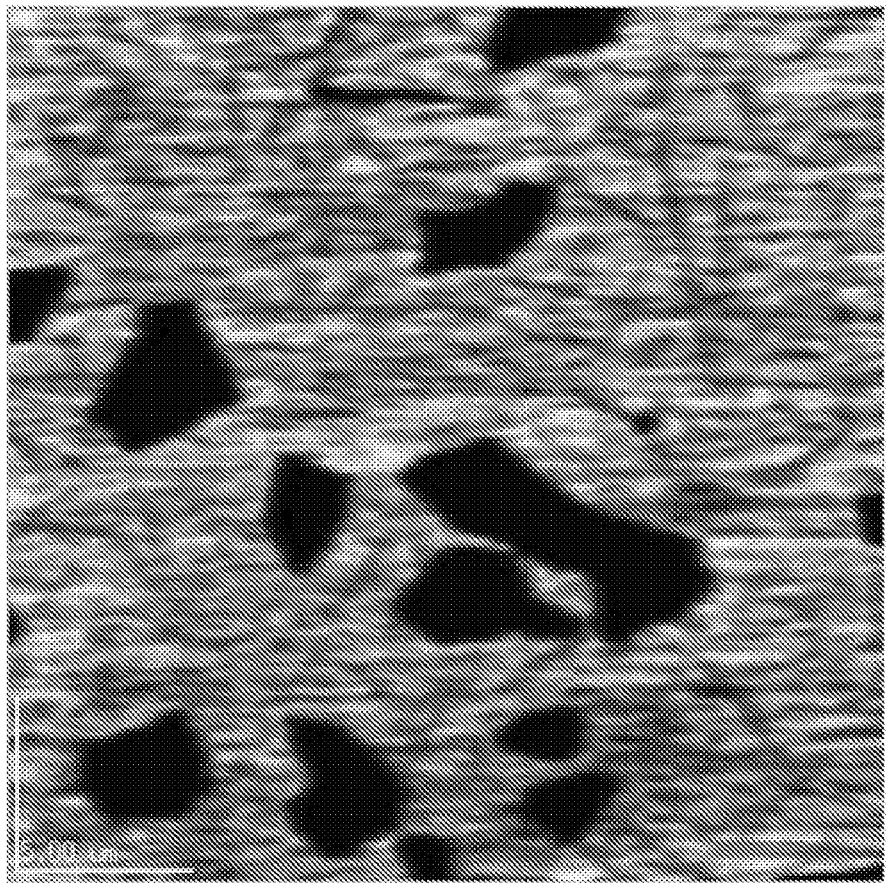
FIG. 22 is a photograph of ceramic crystal grains of a NTC thermistor ceramic which is another example of the present invention observed with a scanning ion microscope.

FIG. 22 is a photograph of ceramic grains observed with a scanning ion microscope. In FIG. 22, dispersed matter in the form of black lines is the plate crystals serving as the second phase. The matter dispersed in the form of black dots is the manganese-calcium compound serving as the third phase. They exist as $CaMn_2O_4$ or $CaMnO_3$.

The electrical resistance of the first, second, and third phases was directly measured by analysis using a scanning probe microscope (SPM). As a result, it was found that the electrical resistance of the second phase and third phase was higher than that of the first phase, the electrical resistance of the second phase was at least 10 times larger than the electrical resistance of the first phase, and the electrical resistance of the third phase was at least 100 times larger than the electrical resistance of the first phase.

Example 5B

Green sheets obtained in EXAMPLE 5A were used to prepare a multilayer NTC thermistor shown in FIG. 3 as in EXAMPLE 2B.

The voltage resistance was evaluated by supplying inrush current to the multilayer NTC thermistor. The changes in electrical resistance after application of inrush current and the rate of change in electrical resistance ΔR25 were measured and calculated as in EXAMPLE 1B. From composition Nos. 420, 441, 442, 453, 454, 465, 466, 477, and 478 shown in Tables 8 and 10, multilayer NTC thermistors were prepared, and the inrush current value was varied to measure changes in electrical resistance at the inrush current value and to calculate the rate of change in electrical resistance ΔR25. The results are shown in FIGS. 11 to 14.

Figure 11:
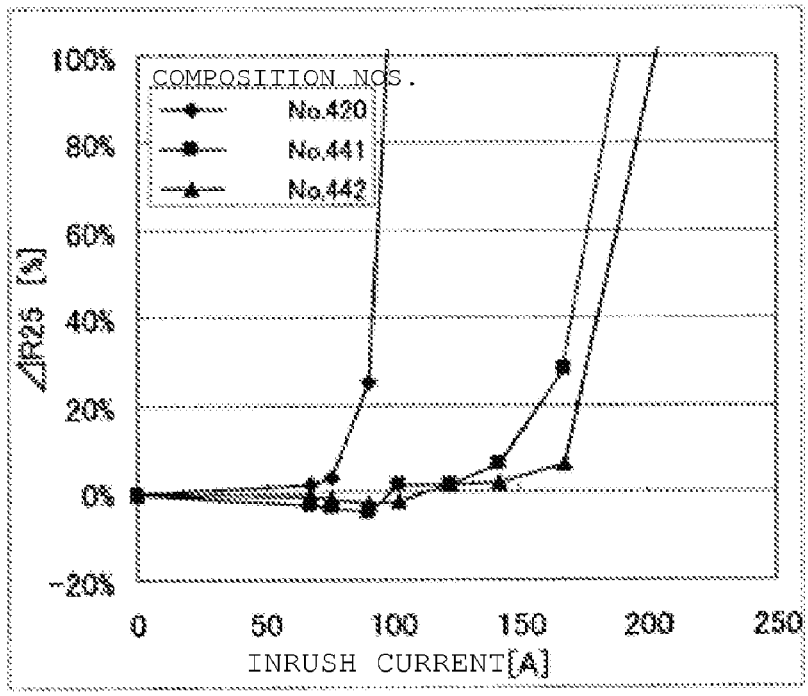
FIG. 11 is a graph showing the relationship between the inrush current value and rate of change in electrical resistance ΔR25 of multilayer NTC thermistors prepared from several compositions of EXAMPLE 5A.

FIG. 11 shows that compared with composition No. 420 containing neither aluminum nor calcium or No. 441 containing aluminum but not calcium, composition No. 442 containing both aluminum and calcium does not undergo changes in electrical resistance until a relatively high inrush current value is reached. This shows that adding aluminum can improve the voltage resistance and adding calcium can improve voltage resistance.

Figure 12:
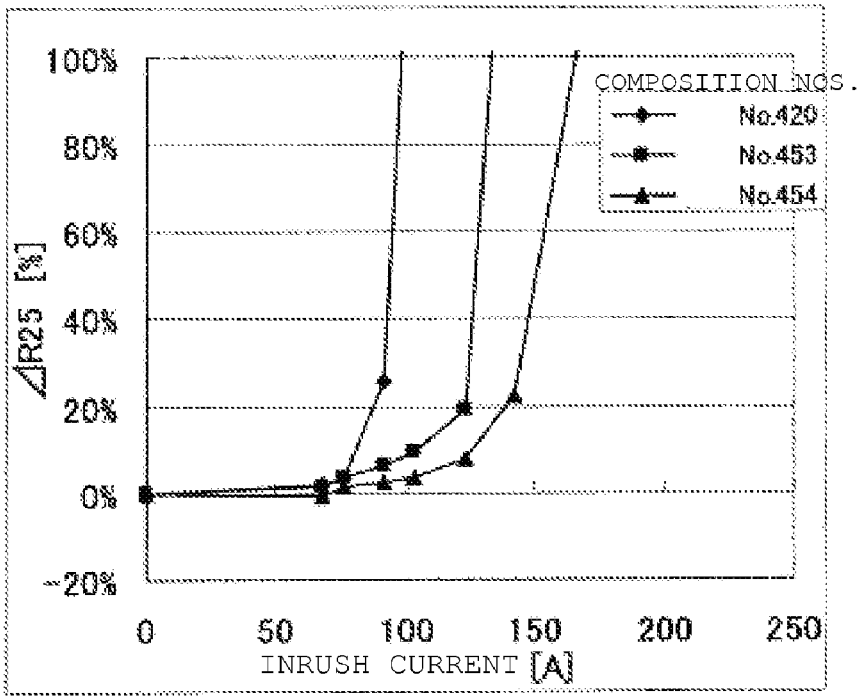
FIG. 12 is another graph showing the relationship between the inrush current value and rate of change in electrical resistance ΔR25 of multilayer NTC thermistors prepared from several compositions of EXAMPLE 5A.

Similarly, FIG. 12 shows that compared with composition No. 420 containing neither iron nor calcium or No. 453 containing iron but not calcium, composition No. 454 containing both iron and calcium does not undergo changes in electrical resistance until a relatively high inrush current value is reached. This shows that adding iron can improve the voltage resistance and adding calcium can improve voltage resistance further.

Figure 13:
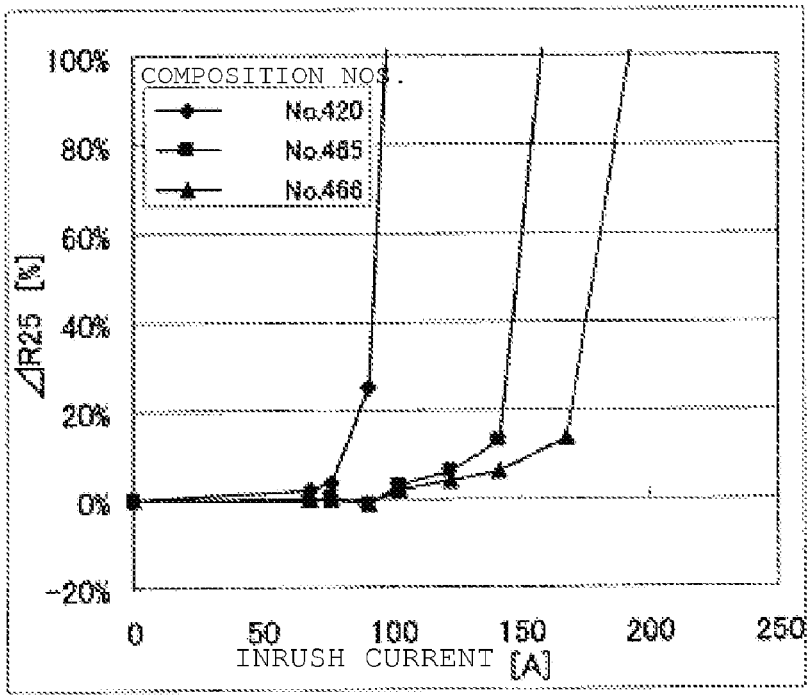
FIG. 13 is another graph showing the relationship between the inrush current value and rate of change in electrical resistance ΔR25 of multilayer NTC thermistors prepared from several compositions of EXAMPLE 5A.

Likewise, FIG. 13 shows that compared with composition No. 420 containing neither cobalt nor calcium or No. 465 containing cobalt but not calcium, composition No. 466 containing both cobalt and calcium does not undergo changes in electrical resistance until a relatively high inrush current value is reached. This shows that adding cobalt can improve the voltage resistance and adding calcium can enhance voltage resistance further.

Figure 14:
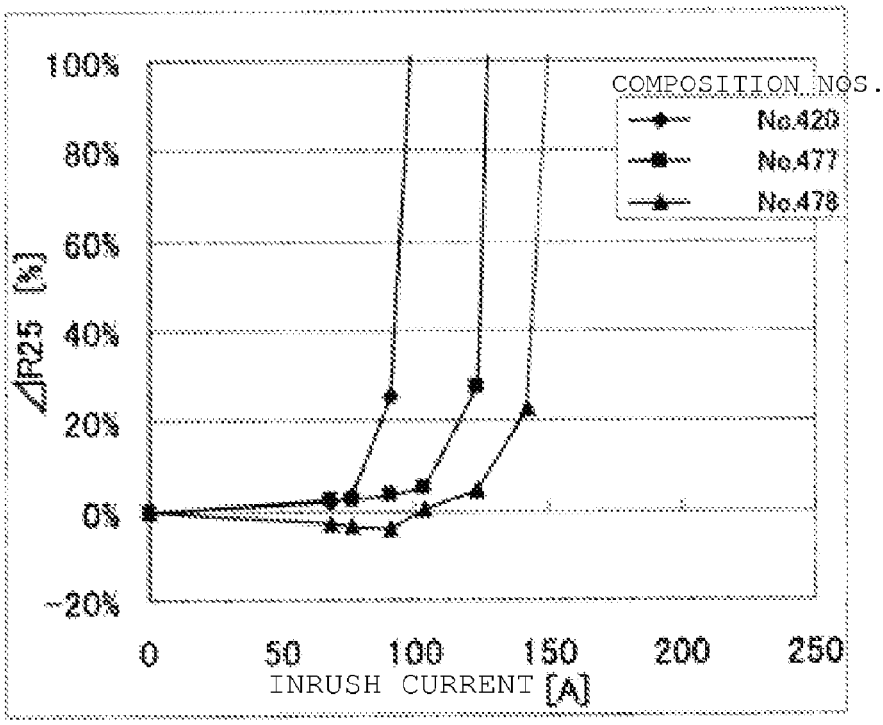
FIG. 14 is another graph showing the relationship between the inrush current value and rate of change in electrical resistance ΔR25 of multilayer NTC thermistors prepared from several compositions of EXAMPLE 5A.

Similarly, FIG. 14 shows that compared with composition No. 420 containing neither titanium nor calcium or No. 477 containing titanium but not calcium, composition No. 478 containing both titanium and calcium does not undergo changes in electrical resistance until a relatively high inrush current value is reached. This shows that adding titanium can improve the voltage resistance and adding calcium can improve voltage resistance further.

Example 6A

Manganese oxide ($Mn_3O_4$), nickel oxide (NiO), copper oxide (CuO), strontium carbonate ($SrCO_3$), aluminum oxide ($Al_2O_3$), iron oxide ($Fe_2O_3$), cobalt oxide ($CO_3O_4$), and titanium oxide ($TiO_2$) were weighed and blended so that the atomic ratios (atom %) of manganese (Mn), nickel (Ni), copper (Cu), strontium (Sr), aluminum (Al), iron (Fe), cobalt (Co), and titanium (Ti) after firing were adjusted to ratios shown in Tables 11 to 13. Then green sheets were prepared as in EXAMPLE 1A.

The resulting green sheets were stacked, pressed, and fired as in EXAMPLE 1A to prepare a ceramic element body as the NTC thermistor ceramic of the present invention. Electrodes were formed on the ceramic main body as in EXAMPLE 1A to obtain a single plate-type NTC thermistor.

The electrical characteristics, voltage resistance, and reliability of each sample of the single plate-type NTC thermistor were evaluated as in EXAMPLE 1B. The results are shown in Tables 11 to 13.

TABLE 11

| | | Feed amounts of raw materials | | | | Electrical characteristics | | Voltage resistance ΔR25% after | | |
|---|---|---|---|---|---|---|---|---|---|---|
| Composition No. | Mn/Ni ratio | Mn atom % | Ni atom % | Cu atom % | Sr atom % | ρ25 Ωcm | B25/50 K | application of inrush current | Plate crystal | Judgment |
| 501 | 85/15 | 85.0 | 15.0 | 0.0 | 0.0 | 3243 | 3964 | 61 | No | X |
| 502 | | 76.9 | 13.6 | 4.5 | 5.0 | 184 | 3292 | 55 | No | X |
| 503 | | 75.7 | 13.3 | 6.0 | 5.0 | 88 | 3084 | 37 | No | X |
| 504 | 87/13 | 87.0 | 13.0 | 0.0 | 0.0 | 17600 | 4215 | 2 | Yes | ○ |
| 505 | | 85.3 | 12.7 | 0.0 | 2.0 | 3961 | 4099 | 8 | Yes | ○ |
| 506 | | 82.7 | 12.3 | 0.0 | 5.0 | 3158 | 4085 | 6 | Yes | ○ |
| 507 | | 78.3 | 11.7 | 0.0 | 10.0 | 2257 | 3947 | 68 | No | X |
| 508 | | 78.3 | 11.7 | 10.0 | 0.0 | 337 | 3149 | 3 | Yes | ○ |
| 509 | | 76.6 | 11.4 | 10.0 | 2.0 | 155 | 3078 | 4 | Yes | ○ |
| 510 | | 74.0 | 11.0 | 10.0 | 5.0 | 112 | 2944 | 1 | Yes | ○ |
| 511 | | 69.6 | 10.4 | 10.0 | 10.0 | 65 | 2876 | 32 | No | X |
| 512 | | 74.0 | 11.0 | 15.0 | 0.0 | 102 | 2766 | 4 | Yes | ○ |
| 513 | | 72.2 | 10.8 | 15.0 | 2.0 | 49 | 2709 | 3 | Yes | ○ |
| 514 | | 69.6 | 10.4 | 15.0 | 5.0 | 37 | 2681 | 5 | Yes | ○ |
| 515 | | 65.2 | 9.8 | 15.0 | 10.0 | 25 | 2653 | 42 | No | X |
| 516 | 90/10 | 90.0 | 10.0 | 0.0 | 0.0 | 26890 | 4243 | 2 | Yes | ○ |
| 517 | | 88.2 | 9.8 | 0.0 | 2.0 | 16932 | 4186 | 7 | Yes | ○ |
| 518 | | 85.5 | 9.5 | 0.0 | 5.0 | 6196 | 4081 | 5 | Yes | ○ |
| 519 | | 81.0 | 9.0 | 0.0 | 10.0 | 4106 | 3889 | 41 | No | X |
| 520 | | 81.0 | 9.0 | 10.0 | 0.0 | 206 | 2805 | 3 | Yes | ○ |
| 521 | | 79.2 | 8.8 | 10.0 | 2.0 | 84 | 2801 | 7 | Yes | ○ |
| 522 | | 76.5 | 8.5 | 10.0 | 5.0 | 74 | 2788 | 5 | Yes | ○ |
| 523 | | 72.0 | 8.0 | 10.0 | 10.0 | 66 | 2775 | 23 | No | X |
| 524 | | 76.5 | 8.5 | 15.0 | 0.0 | 67 | 2809 | 7 | Yes | ○ |
| 525 | | 74.7 | 8.3 | 15.0 | 2.0 | 55 | 2799 | 8 | Yes | ○ |
| 526 | | 72.0 | 8.0 | 15.0 | 5.0 | 42 | 2762 | 5 | Yes | ○ |
| 527 | | 67.5 | 7.5 | 15.0 | 10.0 | 30 | 2757 | 31 | No | X |
| 528 | 96/4 | 96.0 | 4.0 | 0.0 | 0.0 | 269383 | 4583 | 5 | Yes | ○ |
| 529 | | 94.1 | 3.9 | 0.0 | 2.0 | 84517 | 4512 | 7 | Yes | ○ |
| 530 | | 91.2 | 3.8 | 0.0 | 5.0 | 65363 | 4393 | 4 | Yes | ○ |

TABLE 11-continued

| Composition No. | Mn/Ni ratio | Feed amounts of raw materials Mn atom % | Ni atom % | Cu atom % | Sr atom % | Electrical characteristics ρ25 Ωcm | B25/50 K | Voltage resistance ΔR25% after application of inrush current | Plate crystal | Judgment |
|---|---|---|---|---|---|---|---|---|---|---|
| 531 | | 86.4 | 3.6 | 0.0 | 10.0 | 48502 | 4300 | 89 | No | X |
| 532 | | 86.4 | 3.6 | 10.0 | 0.0 | 1671 | 2952 | 6 | Yes | ○ |
| 533 | | 84.5 | 3.5 | 10.0 | 2.0 | 889 | 2916 | 2 | Yes | ○ |
| 534 | | 81.6 | 3.4 | 10.0 | 5.0 | 487 | 2831 | 6 | Yes | ○ |
| 535 | | 76.8 | 3.2 | 10.0 | 10.0 | 373 | 2767 | 76 | No | X |
| 536 | | 81.6 | 3.4 | 15.0 | 0.0 | 513 | 2768 | 6 | Yes | ○ |
| 537 | | 79.7 | 3.3 | 15.0 | 2.0 | 338 | 2741 | 4 | Yes | ○ |
| 538 | | 76.8 | 3.2 | 15.0 | 5.0 | 171 | 2708 | 8 | Yes | ○ |
| 539 | | 72.0 | 3.0 | 15.0 | 10.0 | 105 | 2704 | 64 | No | X |
| 540 | 100/0 | 66.7 | 0 | 33.3 | 5.0 | 295 | 2855 | 58 | No | X |

TABLE 12

| Composition No. | Mn/Ni ratio | Feed amounts of raw materials Mn atom % | Ni atom % | Cu atom % | Al atom % | Fe atom % | Co atom % | Ti atom % | Sr atom % | Electrical characteristics ρ25 Ωcm | B25/50 K | Voltage resistance ΔR25% after application of inrush current | Plate crystal | Judgment |
|---|---|---|---|---|---|---|---|---|---|---|---|---|---|---|
| 541 | 90/10 | 78.8 | 8.7 | 7.5 | 5 | 0 | 0 | 0 | 0 | 300 | 2900 | 0 | Yes | ○ |
| 542 | | 77.0 | 8.5 | 7.5 | 5 | 0 | 0 | 0 | 2 | 92 | 2839 | 8 | Yes | ○ |
| 543 | | 74.3 | 8.2 | 7.5 | 5 | 0 | 0 | 0 | 5 | 77 | 2811 | 5 | Yes | ○ |
| 544 | | 74.3 | 8.2 | 7.5 | 10 | 0 | 0 | 0 | 0 | 152 | 2947 | 6 | Yes | ○ |
| 545 | | 72.5 | 8.0 | 7.5 | 10 | 0 | 0 | 0 | 2 | 129 | 2914 | 1 | Yes | ○ |
| 546 | | 69.8 | 7.7 | 7.5 | 10 | 0 | 0 | 0 | 5 | 104 | 2836 | 2 | Yes | ○ |
| 547 | | 69.8 | 7.7 | 7.5 | 15 | 0 | 0 | 0 | 0 | 390 | 3119 | 20 | No | X |
| 548 | | 68.0 | 7.5 | 7.5 | 15 | 0 | 0 | 0 | 2 | 361 | 3069 | 44 | No | X |
| 549 | | 65.3 | 7.2 | 7.5 | 15 | 0 | 0 | 0 | 5 | 347 | 3062 | 83 | No | X |
| 550 | | 78.8 | 8.7 | 7.5 | 0 | 5 | 0 | 0 | 0 | 688 | 2828 | 5 | Yes | ○ |
| 551 | | 77.0 | 8.5 | 7.5 | 0 | 5 | 0 | 0 | 2 | 261 | 2773 | 4 | Yes | ○ |
| 552 | | 74.3 | 8.2 | 7.5 | 0 | 5 | 0 | 0 | 5 | 86 | 2706 | 2 | Yes | ○ |
| 553 | | 77.4 | 8.6 | 9.0 | 0 | 5 | 0 | 0 | 0 | 510 | 2746 | −3 | Yes | ○ |
| 554 | | 75.6 | 8.4 | 9.0 | 0 | 5 | 0 | 0 | 2 | 227 | 2719 | 1 | Yes | ○ |
| 555 | | 72.9 | 8.1 | 9.0 | 0 | 5 | 0 | 0 | 5 | 79 | 2711 | 5 | Yes | ○ |
| 556 | | 75.2 | 8.3 | 6.5 | 0 | 10 | 0 | 0 | 0 | 3962 | 3150 | 7 | Yes | ○ |
| 557 | | 73.4 | 8.1 | 6.5 | 0 | 10 | 0 | 0 | 2 | 595 | 3087 | 3 | Yes | ○ |
| 558 | | 70.7 | 7.8 | 6.5 | 0 | 10 | 0 | 0 | 5 | 388 | 2974 | −4 | Yes | ○ |
| 559 | | 69.8 | 7.7 | 7.5 | 0 | 15 | 0 | 0 | 0 | 3452 | 3112 | 34 | No | X |
| 560 | | 68.0 | 7.5 | 7.5 | 0 | 15 | 0 | 0 | 2 | 779 | 3069 | 31 | No | X |
| 561 | | 65.3 | 7.2 | 7.5 | 0 | 15 | 0 | 0 | 5 | 482 | 3022 | 76 | No | X |

TABLE 13

| Composition No. | Mn/Ni ratio | Feed amounts of raw materials Mn atom % | Ni atom % | Cu atom % | Al atom % | Fe atom % | Co atom % | Ti atom % | Sr atom % | Electrical characteristics ρ25 Ωcm | B25/50 K | Voltage resistance ΔR25% after application of inrush current | Plate crystal | Judgment |
|---|---|---|---|---|---|---|---|---|---|---|---|---|---|---|
| 562 | 90/10 | 78.8 | 8.7 | 7.5 | 0 | 0 | 5 | 0 | 0 | 491 | 3022 | −1 | Yes | ○ |
| 563 | | 77.0 | 8.5 | 7.5 | 0 | 0 | 5 | 0 | 2 | 119 | 2861 | 2 | Yes | ○ |
| 564 | | 74.3 | 8.2 | 7.5 | 0 | 0 | 5 | 0 | 5 | 55 | 2799 | 3 | Yes | ○ |
| 565 | | 77.4 | 8.6 | 9.0 | 0 | 0 | 5 | 0 | 0 | 330 | 2939 | −7 | Yes | ○ |
| 566 | | 75.6 | 8.4 | 9.0 | 0 | 0 | 5 | 0 | 2 | 107 | 2819 | 3 | Yes | ○ |
| 567 | | 72.9 | 8.1 | 9.0 | 0 | 0 | 5 | 0 | 5 | 79 | 2801 | 5 | Yes | ○ |
| 568 | | 74.3 | 8.2 | 7.5 | 0 | 0 | 10 | 0 | 0 | 356 | 3049 | 1 | Yes | ○ |
| 569 | | 72.5 | 8.0 | 7.5 | 0 | 0 | 10 | 0 | 2 | 162 | 2946 | −4 | Yes | ○ |
| 570 | | 69.8 | 7.7 | 7.5 | 0 | 0 | 10 | 0 | 5 | 89 | 2858 | 8 | Yes | ○ |
| 571 | | 69.8 | 7.7 | 7.5 | 0 | 0 | 15 | 0 | 0 | 210 | 3082 | 5 | Yes | ○ |
| 572 | | 68.0 | 7.5 | 7.5 | 0 | 0 | 15 | 0 | 2 | 135 | 2903 | 5 | Yes | ○ |
| 573 | | 65.3 | 7.2 | 7.5 | 0 | 0 | 15 | 0 | 5 | 93 | 2866 | 7 | Yes | ○ |
| 574 | | 78.8 | 8.7 | 7.5 | 0 | 0 | 0 | 5 | 0 | 964 | 2888 | 6 | Yes | ○ |
| 575 | | 77.0 | 8.5 | 7.5 | 0 | 0 | 0 | 5 | 2 | 481 | 2808 | 3 | Yes | ○ |
| 576 | | 74.3 | 8.2 | 7.5 | 0 | 0 | 0 | 5 | 5 | 292 | 2756 | 1 | Yes | ○ |
| 577 | | 77.4 | 8.6 | 9.0 | 0 | 0 | 0 | 5 | 0 | 574 | 2851 | 7 | Yes | ○ |

TABLE 13-continued

| Composition No. | Mn/Ni ratio | Feed amounts of raw materials: Mn atom % | Ni atom % | Cu atom % | Al atom % | Fe atom % | Co atom % | Ti atom % | Sr atom % | Electrical characteristics: ρ25 Ωcm | B25/50 K | Voltage resistance ΔR25% after application of inrush current | Plate crystal | Judgment |
|---|---|---|---|---|---|---|---|---|---|---|---|---|---|---|
| 578 | | 75.6 | 8.4 | 9.0 | 0 | 0 | 0 | 5 | 2 | 219 | 2796 | −5 | Yes | ○ |
| 579 | | 72.9 | 8.1 | 9.0 | 0 | 0 | 0 | 5 | 5 | 84 | 2779 | 2 | Yes | ○ |
| 580 | | 74.3 | 8.2 | 7.5 | 0 | 0 | 0 | 10 | 0 | 4058 | 3182 | 46 | No | X |
| 581 | | 72.5 | 8.0 | 7.5 | 0 | 0 | 0 | 10 | 2 | 664 | 2996 | 31 | No | X |
| 582 | | 69.8 | 7.7 | 7.5 | 0 | 0 | 0 | 10 | 5 | 422 | 2952 | 55 | No | X |

As shown in Table 11, among all samples of NTC thermistors, for composition Nos. 501 to 540, when the atomic (manganese content)/(nickel content) ratio is 87/13 or more and 96/4 or less, 15 at % or less copper is present, and 5 at % or less (excluding 0 at %) strontium is further present, not only plate crystals mainly composed of manganese oxide serving as the second phase having a high electrical resistance but also $SrMnO_3$ that serves as a third phase having a high electrical resistance is dispersed in the first phase, i.e., the matrix showing a low electrical resistance. Thus, electrical current concentration on the first phase is moderated, fracture caused by heat melting is suppressed, and the voltage resistance can be enhanced.

As shown in Tables 12 and 13, among all samples of NTC thermistors, for composition Nos. 541 to 582, when the atomic (manganese content)/(nickel content) ratio is 87/13 or more and 96/4 or less, 15 at % or less copper is present, 10 at % or less aluminum, 10 at % or less iron, 15 at % or less cobalt, or 5 at % or less titanium is further present, and 5 at % or less (excluding 0 at %) strontium is yet further present, not only plate crystals mainly composed manganese oxide serving as the second phase having a high electrical resistance but also $SrMnO_3$ serving as a third phase having a high electrical resistance is dispersed in the first phase, i.e., the matrix having a low electrical resistance. Thus, the electrical current concentration on the first phase is moderated, fracture caused by heat melting is suppressed, and the hardness or fracture toughness of the NTC thermistor ceramic can be improved. Thus, fracture attributable to cracks can be suppressed, and the voltage resistance can be further improved.

Example 6B

Green sheets obtained in EXAMPLE 6A were used to prepare a multilayer NTC thermistor shown in FIG. 3 as in EXAMPLE 2B.

The voltage resistance was evaluated by supplying inrush current to the multilayer NTC thermistor. The changes in electrical resistance after application of inrush current and the rate of change in electrical resistance ΔR25 were measured and calculated as in EXAMPLE 1B. From composition Nos. 520, 541, 542, 553, 554, 565, 566, 577, and 578 shown in Tables 11 and 13, multilayer NTC thermistors were prepared, and the inrush current value was varied to measure changes in electrical resistance at the inrush current value and to calculate the rate of change in electrical resistance ΔR25. The results are shown in FIGS. 15 to 18.

Figure 15:
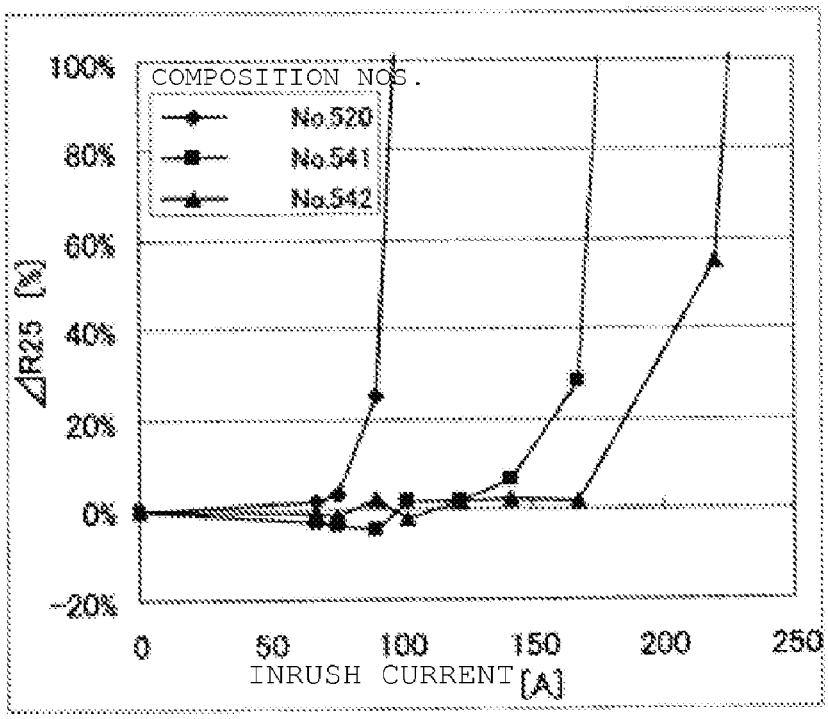
FIG. 15 is a graph showing the relationship between the inrush current value and rate of change in electrical resistance ΔR25 of multilayer NTC thermistors prepared from several compositions of EXAMPLE 6A.

FIG. 15 shows that compared with composition No. 520 containing neither aluminum nor strontium or No. 541 containing aluminum but not strontium, composition No. 542 containing both aluminum and strontium does not undergo changes in electrical resistance until a relatively high inrush current value is reached. This shows that adding aluminum can improve the voltage resistance and adding strontium can improve voltage resistance further.

Figure 16:
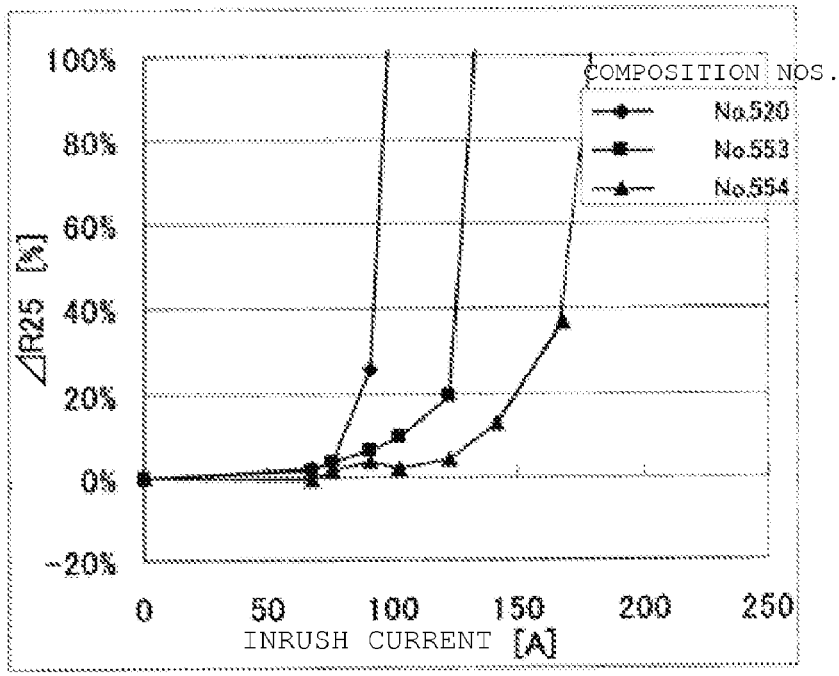
FIG. 16 is another graph showing the relationship between the inrush current value and rate of change in electrical resistance ΔR25 of multilayer NTC thermistors prepared from several compositions of EXAMPLE 6A.

Similarly, FIG. 16 shows that compared with composition No. 520 containing neither iron nor strontium or No. 553 containing iron but not strontium, composition No. 554 containing both iron and strontium does not undergo changes in electrical resistance until a relatively high inrush current value is reached. This shows that adding iron can improve the voltage resistance and adding strontium can improve voltage resistance further.

Figure 17:
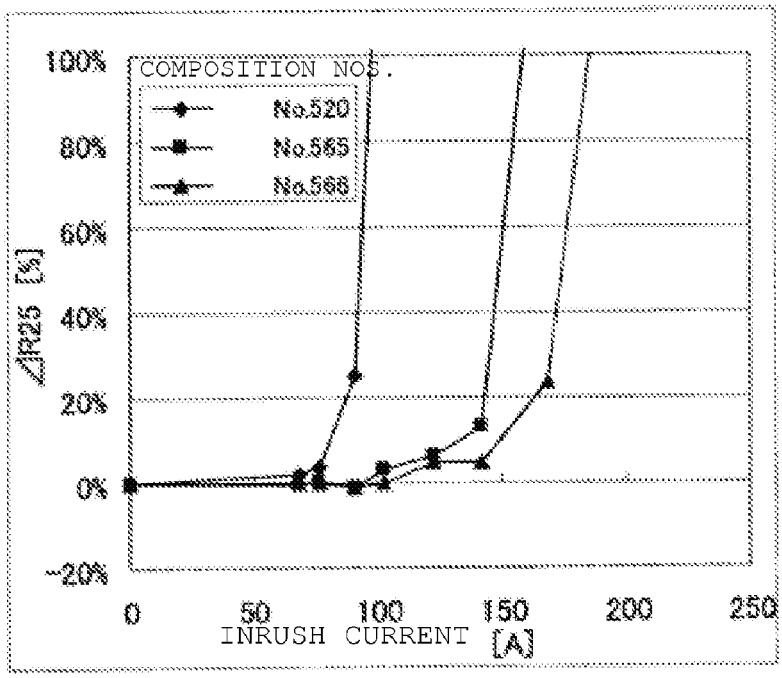
FIG. 17 is another graph showing the relationship between the inrush current value and rate of change in electrical resistance ΔR25 of multilayer NTC thermistors prepared from several compositions of EXAMPLE 6A.

Likewise, FIG. 17 shows that compared with composition No. 520 containing neither cobalt nor strontium or No. 565 containing cobalt but not strontium, composition No. 566 containing both cobalt and strontium does not undergo changes in electrical resistance until a relatively high inrush current value is reached. This shows that adding cobalt can improve the voltage resistance and adding strontium can improve voltage resistance further.

Figure 18:
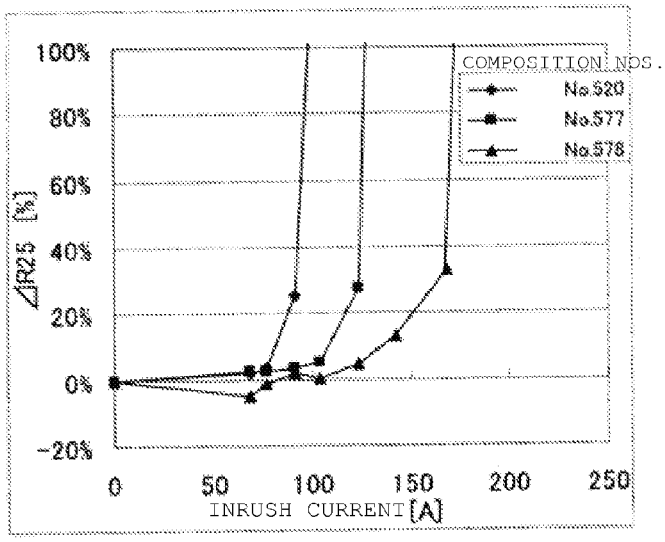
FIG. 18 is another graph showing the relationship between the inrush current value and rate of change in electrical resistance ΔR25 of multilayer NTC thermistors prepared from several compositions of EXAMPLE 6A.

Similarly, FIG. 18 shows that compared with composition No. 520 containing neither titanium nor strontium or No. 577 containing titanium but not strontium, composition No. 578 containing both titanium and strontium does not undergo changes in electrical resistance until a relatively high inrush current value is reached. This shows that adding titanium can improve the voltage resistance and adding strontium can improve voltage resistance further.

Example 7A

Manganese oxide ($Mn_3O_4$), cobalt oxide ($CO_3O_4$), copper oxide (CuO), aluminum oxide ($Al_2O_3$), iron oxide ($Fe_2O_3$), nickel oxide (NiO), and zirconium oxide ($ZrO_2$) were weighed and blended so that the atomic ratios (atom %) of manganese (Mn), cobalt (Co), copper (Cu), aluminum (Al), iron (Fe), nickel (Ni), and zirconium (Zr) after firing were adjusted to ratios shown in Table 14. Then green sheets were prepared as in EXAMPLE 1A.

The resulting green sheets were stacked, pressed, and fired as in EXAMPLE 1A to prepare a ceramic element body as the NTC thermistor ceramic of the present invention. Electrodes were formed on the ceramic main body as in EXAMPLE 1A to obtain a single plate-type NTC thermistor.

The electrical characteristics, voltage resistance, and reliability of each sample of the single plate-type NTC thermistor were evaluated as in EXAMPLE 1B. The results are shown in Table 14.

TABLE 14

| Composition No. | Mn/Co ratio | Mn atom % | Co atom % | Cu atom % | Al atom % | Fe atom % | Ni atom % | Zr atom % | Electrical characteristics ρ25 Ωcm | Electrical characteristics B25/50 K | ΔR25% after application of inrush current | Plate crystal | Judgement |
|---|---|---|---|---|---|---|---|---|---|---|---|---|---|
| 601 | 60/40 | 57.0 | 38.0 | 5.0 | — | — | — | — | 453 | 3684 | 6 | Yes | ○ |
| 602 | | 55.6 | 37.1 | 7.0 | — | — | — | 0.3 | 183 | 3460 | 4 | Yes | ○ |
| 603 | | 55.4 | 37.0 | 7.0 | — | — | — | 0.6 | 163 | 3329 | 1 | Yes | ○ |
| 604 | | 55.2 | 36.8 | 7.0 | — | — | — | 1.0 | 154 | 3274 | 3 | Yes | ○ |
| 605 | | 54.9 | 36.6 | 7.0 | — | — | — | 1.5 | 220 | 3364 | 3 | Yes | ○ |
| 606 | 70/30 | 63.0 | 27.0 | 10.0 | — | — | — | — | 290 | 3250 | 7 | Yes | ○ |
| 607 | | 63.7 | 27.3 | 9.0 | — | — | — | — | 500 | 3311 | 2 | Yes | ○ |
| 608 | | 63.5 | 27.2 | 9.0 | — | — | — | 0.3 | 517 | 3354 | 0 | Yes | ○ |
| 609 | | 63.3 | 27.1 | 9.0 | — | — | — | 0.6 | 452 | 3275 | −1 | Yes | ○ |
| 610 | | 63.0 | 27.0 | 9.0 | — | — | — | 1.0 | 419 | 3266 | 1 | Yes | ○ |
| 611 | | 62.7 | 26.8 | 9.0 | — | — | — | 1.5 | 595 | 3345 | 1 | Yes | ○ |
| 612 | 80/20 | 66.6 | 16.7 | 16.7 | — | — | — | — | 129 | 2783 | 8 | Yes | ○ |
| 613 | | 70.8 | 17.7 | 11.5 | — | — | — | — | 278 | 2959 | 5 | Yes | ○ |
| 614 | | 70.7 | 17.7 | 11.5 | — | — | — | 0.1 | 336 | 2964 | −3 | Yes | ○ |
| 615 | | 70.6 | 17.7 | 11.5 | — | — | — | 0.2 | 316 | 2938 | 1 | Yes | ○ |
| 616 | | 70.6 | 17.6 | 11.5 | — | — | — | 0.3 | 255 | 2883 | 0 | Yes | ○ |
| 617 | | 70.3 | 17.6 | 11.5 | — | — | — | 0.6 | 230 | 2846 | −2 | Yes | ○ |
| 618 | | 70.0 | 17.5 | 11.5 | — | — | — | 1.0 | 235 | 2822 | 3 | Yes | ○ |
| 619 | | 69.6 | 17.4 | 11.5 | — | — | — | 1.5 | 386 | 2839 | 2 | Yes | ○ |
| 620 | | 66.8 | 16.7 | 11.5 | 5.0 | — | — | — | 523 | 3005 | 3 | Yes | ○ |
| 621 | | 66.6 | 16.6 | 11.5 | 5.0 | — | — | 0.3 | 510 | 2971 | 2 | Yes | ○ |
| 622 | | 65.6 | 16.4 | 11.5 | 5.0 | — | — | 1.5 | 636 | 3124 | 2 | Yes | ○ |
| 623 | | 58.8 | 14.7 | 11.5 | 15.0 | — | — | — | 121 | 2795 | 2 | Yes | ○ |
| 624 | | 58.6 | 14.6 | 11.5 | 15.0 | — | — | 0.3 | 109 | 2777 | 1 | Yes | ○ |
| 625 | | 57.6 | 14.4 | 11.5 | 15.0 | — | — | 1.5 | 156 | 2855 | −1 | Yes | ○ |
| 626 | | 66.8 | 16.7 | 11.5 | — | 5.0 | — | — | 682 | 3019 | 2 | Yes | ○ |
| 627 | | 66.6 | 16.6 | 11.5 | — | 5.0 | — | 0.3 | 611 | 3007 | −1 | Yes | ○ |
| 628 | | 65.6 | 16.4 | 11.5 | — | 5.0 | — | 1.5 | 866 | 3085 | 1 | Yes | ○ |
| 629 | | 56.8 | 14.2 | 14.0 | — | 15.0 | — | — | 320 | 2912 | 2 | Yes | ○ |
| 630 | | 56.6 | 14.1 | 14.0 | — | 15.0 | — | 0.3 | 298 | 2902 | 0 | Yes | ○ |
| 631 | | 55.6 | 13.9 | 14.0 | — | 15.0 | — | 1.5 | 400 | 2936 | −1 | Yes | ○ |
| 632 | | 68.8 | 17.2 | 9.0 | — | — | 5.0 | — | 331 | 3080 | 1 | Yes | ○ |
| 633 | | 68.6 | 17.1 | 9.0 | — | — | 5.0 | 0.3 | 311 | 3044 | 0 | Yes | ○ |
| 634 | | 67.6 | 16.9 | 9.0 | — | — | 5.0 | 1.5 | 410 | 3116 | 0 | Yes | ○ |
| 635 | | 60.8 | 15.2 | 9.0 | — | — | 15.0 | — | 72 | 3014 | 6 | Yes | ○ |
| 636 | | 60.6 | 15.1 | 9.0 | — | — | 15.0 | 0.3 | 66 | 2985 | 3 | Yes | ○ |
| 637 | | 59.6 | 14.9 | 9.0 | — | — | 15.0 | 1.5 | 94 | 3125 | 4 | Yes | ○ |
| 638 | 90/10 | 70.2 | 7.8 | 22.0 | — | — | — | — | 312 | 2512 | 7 | Yes | ○ |
| 639 | | 74.7 | 8.3 | 17.0 | — | — | — | — | 237 | 2732 | 5 | Yes | ○ |
| 640 | | 74.4 | 8.3 | 17.0 | — | — | — | 0.3 | 214 | 2712 | 3 | Yes | ○ |
| 641 | | 74.2 | 8.2 | 17.0 | — | — | — | 0.6 | 208 | 2688 | −2 | Yes | ○ |
| 642 | | 73.8 | 8.2 | 17.0 | — | — | — | 1.0 | 202 | 2701 | 1 | Yes | ○ |
| 643 | | 73.4 | 8.1 | 17.0 | — | — | — | 1.5 | 280 | 2756 | 4 | Yes | ○ |
| 644 | 100/0 | 66.7 | — | 33.0 | — | — | — | | 229 | 2889 | 24 | No | X |

As shown in Table 14, among all samples of NTC thermistors, for composition Nos. 601 to 637 and 639 to 643, when the atomic (manganese content)/(cobalt content) ratio is 60/40 or more and 90/10 or less, 17 at % or less copper is present, at least one of 15 at % or less aluminum, 15 at % or less iron, and 15 at % or less nickel is further present, and 1.5 at % or less (excluding 0%) zirconium is yet also present, plate crystals mainly composed of manganese oxide serving as the second phase having a high electrical resistance is dispersed in the first phase, i.e., the matrix showing a low electrical resistance. Thus, not only electrical current concentration on the first phase is moderated and fracture caused by heat melting is suppressed, but also the hardness or fracture toughness of the NTC thermistor ceramic can be enhanced. Thus, fracture attributable to cracks can be suppressed. Since segregation of zirconium oxide in the ceramic grain boundaries is observed, the hardness or fracture toughness of the NTC thermistor ceramic can be substantially retained at a high value, and thus the voltage resistance can be improved.

Example 7B

Green sheets obtained in EXAMPLE 7A were used to prepare a multilayer NTC thermistor shown in FIG. 3 as in EXAMPLE 2B.

The voltage resistance was evaluated by supplying inrush current to the multilayer NTC thermistor. The changes in electrical resistance after application of inrush current and the rate of change in electrical resistance ΔR25 were measured and calculated as in EXAMPLE 1B. From composition Nos. 613 and 616 shown in Table 14, multilayer NTC thermistors were prepared, and the inrush current value was varied to measure changes in electrical resistance at the inrush current value and to calculate the rate of change in electrical resistance ΔR25. The results are shown in FIG. 19.

Figure 19:
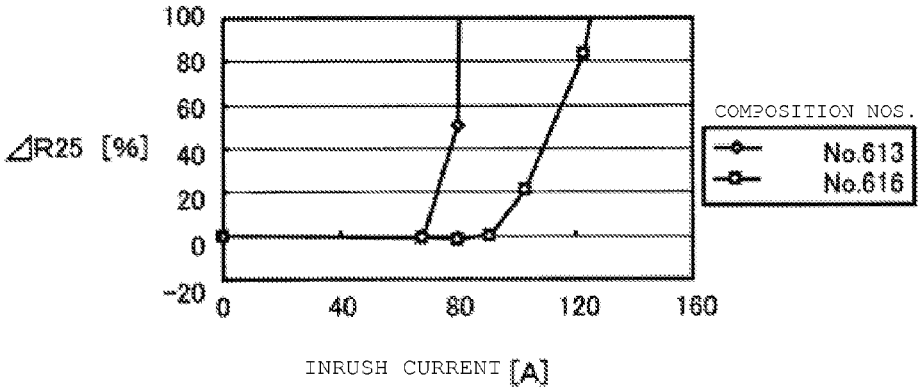
FIG. 19 is a graph showing the relationship between the inrush current value and rate of change in electrical resistance ΔR25 of multilayer NTC thermistors prepared from several compositions of EXAMPLE 7A.

FIG. 19 shows that compared with composition No. 616 containing no zirconium but having the second phase with a high electrical resistance, composition No. 613 containing 0.3 at % zirconium does not undergo changes in electrical resistance until a relatively high inrush current value is reached. Adding zirconium can further improve the voltage resistance.

Example 8A

Manganese oxide ($Mn_3O_4$), cobalt oxide ($CO_3O_4$), copper oxide (CuO), calcium carbonate ($CaCO_3$), aluminum oxide ($Al_2O_3$), iron oxide ($Fe_2O_3$), and nickel oxide (NiO) were weighed and blended so that the atomic ratios (atom %) of manganese (Mn), cobalt (Co), copper (Cu), calcium (Ca), aluminum (Al), iron (Fe), and nickel (Ni) after firing were adjusted to ratios shown in Tables 15 to 17. Then green sheets were prepared as in EXAMPLE 1A.

The resulting green sheets were stacked, pressed, and fired as in EXAMPLE 1A to prepare a ceramic element body serving as the NTC thermistor ceramic of the present invention. Electrodes were formed on the ceramic main body as in EXAMPLE 1A to obtain a single plate-type NTC thermistor.

The electrical characteristics, voltage resistance, and reliability of each sample of the single plate-type NTC thermistor were evaluated as in EXAMPLE 1B. The results are shown in Tables 15 to 17.

TABLE 15

| Composition No. | Mn/Co ratio | Mn atom % | Co atom % | Cu atom % | Al atom % | Fe atom % | Ni atom % | Ca atom % | Electrical characteristics ρ25 Ωcm | Electrical characteristics B25/50 K | ΔR25% after application of inrush current | Plate crystal | Judgement |
|---|---|---|---|---|---|---|---|---|---|---|---|---|---|
| 701 | 60/40 | 57.0 | 38.0 | 5.0 | — | — | — | — | 453 | 3684 | 6 | Yes | ○ |
| 702 | | 54.3 | 36.2 | 7.0 | — | — | — | 2.5 | 66 | 3203 | 3 | Yes | ○ |
| 703 | | 52.8 | 35.2 | 7.0 | — | — | — | 5.0 | 48 | 3158 | 4 | Yes | ○ |
| 704 | | 49.8 | 33.2 | 7.0 | — | — | — | 10.0 | 27 | 3081 | 25 | No | X |
| 705 | 70/30 | 63.0 | 27.0 | 10.0 | — | — | — | — | 290 | 3250 | 7 | Yes | ○ |
| 706 | | 61.2 | 26.3 | 7.5 | — | — | 5.0 | — | 88 | 3068 | 2 | Yes | ○ |
| 707 | | 60.5 | 26.0 | 7.5 | — | — | 5.0 | 1.0 | 36 | 2924 | 0 | Yes | ○ |
| 708 | | 59.5 | 25.5 | 7.5 | — | — | 5.0 | 2.5 | 42 | 2940 | 1 | Yes | ○ |
| 709 | | 57.7 | 24.8 | 7.5 | — | — | 5.0 | 5.0 | 32 | 2899 | 0 | Yes | ○ |
| 710 | | 60.5 | 26.0 | 7.5 | 5.0 | — | — | 1.0 | 173 | 3133 | 0 | Yes | ○ |
| 711 | | 59.5 | 25.5 | 7.5 | 5.0 | — | — | 2.5 | 198 | 3164 | −1 | Yes | ○ |
| 712 | | 57.7 | 24.8 | 7.5 | 5.0 | — | — | 5.0 | 136 | 3001 | −1 | Yes | ○ |
| 713 | | 60.5 | 26.0 | 7.5 | — | 5.0 | — | 1.0 | 193 | 3161 | 2 | Yes | ○ |
| 714 | | 59.5 | 25.5 | 7.5 | — | 5.0 | — | 2.5 | 212 | 3222 | 1 | Yes | ○ |
| 715 | | 57.7 | 24.8 | 7.5 | — | 5.0 | — | 5.0 | 154 | 3089 | 0 | Yes | ○ |

TABLE 16

| Composition No. | Mn/Co ratio | Mn atom % | Co atom % | Cu atom % | Al atom % | Fe atom % | Ni atom % | Ca atom % | Electrical characteristics ρ25 Ωcm | Electrical characteristics B25/50 K | ΔR25% after application of inrush current | Plate crystal | Judgement |
|---|---|---|---|---|---|---|---|---|---|---|---|---|---|
| 716 | 80/20 | 66.6 | 16.7 | 16.7 | — | — | — | — | 129 | 2783 | 8 | Yes | ○ |
| 717 | | 70.0 | 17.5 | 11.5 | — | — | — | 1.0 | 136 | 2828 | 2 | Yes | ○ |
| 718 | | 68.8 | 17.2 | 11.5 | — | — | — | 2.5 | 202 | 2886 | 3 | Yes | ○ |
| 719 | | 66.8 | 16.7 | 11.5 | — | — | — | 5.0 | 78 | 2799 | 1 | Yes | ○ |
| 720 | | 66.8 | 16.7 | 11.5 | 5.0 | — | — | — | 523 | 3005 | 3 | Yes | ○ |
| 721 | | 66.0 | 16.5 | 11.5 | 5.0 | — | — | 1.0 | 68 | 2717 | 1 | Yes | ○ |
| 722 | | 64.8 | 16.2 | 11.5 | 5.0 | — | — | 2.5 | 73 | 2713 | 2 | Yes | ○ |
| 723 | | 62.8 | 15.7 | 11.5 | 5.0 | — | — | 5.0 | 42 | 2596 | 2 | Yes | ○ |
| 724 | | 58.8 | 14.7 | 11.5 | 5.0 | — | — | 10.0 | 22 | 2525 | 21 | No | X |
| 725 | | 62.8 | 15.7 | 11.5 | 10.0 | — | — | — | 358 | 2914 | 4 | Yes | ○ |
| 726 | | 62.0 | 15.5 | 11.5 | 10.0 | — | — | 1.0 | 82 | 2702 | 0 | Yes | ○ |
| 727 | | 60.8 | 15.2 | 11.5 | 10.0 | — | — | 2.5 | 197 | 2884 | 3 | Yes | ○ |
| 728 | | 58.8 | 14.7 | 11.5 | 10.0 | — | — | 5.0 | 117 | 3008 | 2 | Yes | ○ |
| 729 | | 58.8 | 14.7 | 11.5 | 15.0 | — | — | — | 121 | 2795 | 2 | Yes | ○ |
| 730 | | 56.8 | 14.2 | 11.5 | 15.0 | — | — | 2.5 | 216 | 3116 | 0 | Yes | ○ |
| 731 | | 54.8 | 13.7 | 11.5 | 15.0 | — | — | 5.0 | 328 | 3204 | 1 | Yes | ○ |
| 732 | | 66.8 | 16.7 | 11.5 | — | 5.0 | — | — | 682 | 3019 | 2 | Yes | ○ |
| 733 | | 66.0 | 16.5 | 11.5 | — | 5.0 | — | 1.0 | 229 | 2777 | −1 | Yes | ○ |
| 734 | | 64.8 | 16.2 | 11.5 | — | 5.0 | — | 2.5 | 124 | 2742 | 0 | Yes | ○ |
| 735 | | 62.8 | 15.7 | 11.5 | — | 5.0 | — | 5.0 | 104 | 2784 | 1 | Yes | ○ |
| 736 | | 58.8 | 14.7 | 11.5 | — | 5.0 | — | 10.0 | 17 | 2524 | 35 | No | X |
| 737 | | 64.0 | 16.0 | 14.0 | — | 5.0 | — | 1.0 | 43 | 2600 | −2 | Yes | ○ |
| 738 | | 62.8 | 15.7 | 14.0 | — | 5.0 | — | 2.5 | 39 | 2535 | 1 | Yes | ○ |
| 739 | | 62.8 | 15.7 | 11.5 | — | 10.0 | — | — | 342 | 2936 | 4 | Yes | ○ |
| 740 | | 60.0 | 15.0 | 14.0 | — | 10.0 | — | 1.0 | 82 | 2588 | 0 | Yes | ○ |
| 741 | | 58.8 | 14.7 | 14.0 | — | 10.0 | — | 2.5 | 75 | 2564 | 2 | Yes | ○ |
| 742 | | 56.8 | 14.2 | 14.0 | — | 10.0 | — | 5.0 | 91 | 2888 | 2 | Yes | ○ |
| 743 | | 56.8 | 14.2 | 14.0 | — | 15.0 | — | — | 320 | 2912 | 2 | Yes | ○ |
| 744 | | 54.8 | 13.7 | 14.0 | — | 15.0 | — | 2.5 | 92 | 2812 | −1 | Yes | ○ |
| 745 | | 52.8 | 13.2 | 14.0 | — | 15.0 | — | 5.0 | 204 | 3023 | 1 | Yes | ○ |
| 746 | | 66.8 | 16.7 | 11.5 | — | — | 5.0 | — | 157 | 2759 | 3 | Yes | ○ |
| 747 | | 66.0 | 16.5 | 11.5 | — | — | 5.0 | 1.0 | 62 | 2723 | −2 | Yes | ○ |
| 748 | | 64.8 | 16.2 | 11.5 | — | — | 5.0 | 2.5 | 49 | 2695 | 1 | Yes | ○ |
| 749 | | 62.8 | 15.7 | 11.5 | — | — | 5.0 | 5.0 | 45 | 2598 | 2 | Yes | ○ |
| 750 | | 58.8 | 14.7 | 11.5 | — | — | 5.0 | 10.0 | 14 | 2611 | 29 | No | X |

TABLE 16-continued

| Composition No. | Mn/Co ratio | Mn atom % | Co atom % | Cu atom % | Al atom % | Fe atom % | Ni atom % | Ca atom % | Electrical characteristics ρ25 Ωcm | Electrical characteristics B25/50 K | ΔR25% after application of inrush current | Plate crystal | Judgement |
|---|---|---|---|---|---|---|---|---|---|---|---|---|---|
| 751 | | 72.8 | 18.2 | 9.0 | — | — | — | — | 477 | 3039 | 4 | Yes | ○ |
| 752 | | 68.8 | 17.2 | 9.0 | — | — | 5.0 | — | 331 | 3080 | 1 | Yes | ○ |
| 753 | | 64.8 | 16.2 | 9.0 | — | — | 5.0 | 5.0 | 48 | 2665 | 3 | Yes | ○ |
| 754 | | 60.8 | 15.2 | 9.0 | — | — | 5.0 | 10.0 | 20 | 2723 | 60 | No | X |
| 755 | | 64.8 | 16.2 | 9.0 | — | — | 10.0 | — | 156 | 2866 | 3 | Yes | ○ |
| 756 | | 62.8 | 15.7 | 11.5 | — | — | 10.0 | — | 113 | 2710 | 4 | Yes | ○ |
| 757 | | 64.0 | 16.0 | 9.0 | — | — | 10.0 | 1.0 | 93 | 2792 | 1 | Yes | ○ |
| 758 | | 62.8 | 15.7 | 9.0 | — | — | 10.0 | 2.5 | 87 | 2860 | 0 | Yes | ○ |
| 759 | | 60.8 | 15.2 | 9.0 | — | — | 10.0 | 5.0 | 84 | 2892 | 2 | Yes | ○ |
| 760 | | 60.8 | 15.2 | 9.0 | — | — | 15.0 | — | 72 | 3014 | 6 | Yes | ○ |
| 761 | | 58.8 | 14.7 | 9.0 | — | — | 15.0 | 2.5 | 54 | 2837 | 3 | Yes | ○ |
| 762 | | 56.8 | 14.2 | 9.0 | — | — | 15.0 | 5.0 | 50 | 2750 | 4 | Yes | ○ |

TABLE 17

| Composition No. | Mn/Co ratio | Mn atom % | Co atom % | Cu atom % | Al atom % | Fe atom % | Ni atom % | Ca atom % | Electrical characteristics ρ25 Ωcm | Electrical characteristics B25/50 K | ΔR25% after application of inrush current | Plate crystal | Judgement |
|---|---|---|---|---|---|---|---|---|---|---|---|---|---|
| 763 | 90/10 | 70.2 | 7.8 | 22.0 | — | — | — | — | 312 | 2512 | 7 | Yes | ○ |
| 764 | | 74.7 | 8.3 | 17.0 | — | — | — | — | 237 | 2732 | 5 | Yes | ○ |
| 765 | | 72.4 | 8.1 | 17.0 | — | — | — | 2.5 | 137 | 2688 | 2 | Yes | ○ |
| 766 | | 70.2 | 7.8 | 17.0 | — | — | — | 5.0 | 48 | 2538 | 3 | Yes | ○ |
| 767 | 100/0 | 66.7 | — | 33.3 | — | — | — | | 229 | 2889 | 24 | No | X |

As shown in Tables 15 to 17, among all samples of NTC thermistors, for composition Nos. 701 to 703, 705 to 723, to 735, 737 to 749, 751 to 753, and 755 to 766, when the atomic (manganese content)/(cobalt content) ratio is 60/40 or more and 90/10 or less, 17 at % or less copper is present, at least one of 15 at % or less aluminum, 15 at % or less iron, and 15 at % or less nickel is further present, and 5 at % or less (excluding 0%) calcium is also present, not only plate crystals mainly composed of manganese oxide serving as the second phase having a high electrical resistance but also $CaMn_2O_4$ or $CaMnO_3$ serving as a third phase having a high electrical resistance is dispersed in the first phase, i.e., the matrix having a low electrical resistance. Thus, the electrical current concentration on the first phase is moderated, fracture caused by heat melting is suppressed, and the voltage resistance can be improved further.

Example 8B

Green sheets obtained in EXAMPLE 8A were used to prepare a multilayer NTC thermistor shown in FIG. 3 as in EXAMPLE 2B.

The voltage resistance was evaluated by supplying inrush current to the multilayer NTC thermistor. The changes in electrical resistance after application of inrush current and the rate of change in electrical resistance ΔR25 were measured and calculated as in EXAMPLE 1B. From composition Nos. 716, 717, 718, and 719 shown in Table 16, multilayer NTC thermistors were prepared, and the inrush current value was varied to measure changes in electrical resistance at the inrush current value and to calculate the rate of change in electrical resistance ΔR25. The results are shown in FIG. 20.

Figure 20:
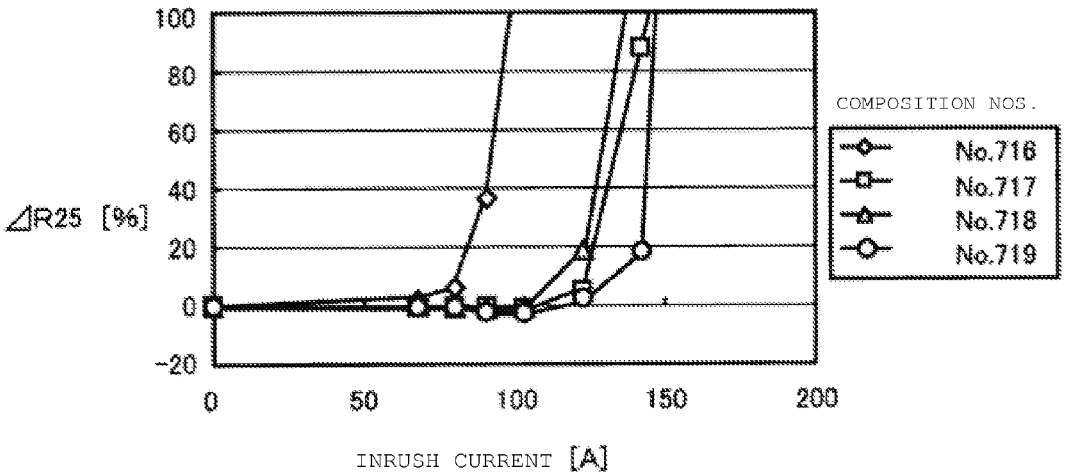
FIG. 20 is a graph showing the relationship between the inrush current value and rate of change in electrical resistance ΔR25 of multilayer NTC thermistors prepared from several compositions of EXAMPLE 8A.

FIG. 20 shows that compared with composition No. 716 containing no calcium, composition Nos. 717, 718, and 719 containing calcium do not undergo changes in electrical resistance until a relatively high inrush current value is reached. Adding calcium can further improve the voltage resistance.

Example 9A

Manganese oxide ($Mn_3O_4$), cobalt oxide ($CO_3O_4$), copper oxide (CuO), strontium carbonate ($SrCO_3$), aluminum oxide ($Al_2O_3$), iron oxide ($Fe_2O_3$), and nickel oxide (NiO) were weighed and blended so that the atomic ratios (atom %) of manganese (Mn), cobalt (Co), copper (Cu), strontium (Sr), aluminum (Al), iron (Fe), and nickel (Ni) after firing were adjusted to ratios shown in Table 18. Then green sheets were prepared as in EXAMPLE 1A.

The resulting green sheets were stacked, pressed, and fired as in EXAMPLE 1A to prepare a ceramic element body as the NTC thermistor ceramic of the present invention. Electrodes were formed on the ceramic main body as in EXAMPLE 1A to obtain a single plate-type NTC thermistor.

The electrical characteristics, voltage resistance, and reliability of each sample of the single plate-type NTC thermistor were evaluated as in EXAMPLE 1B. The results are shown in Table 18.

TABLE 18

| Composition No. | Mn/Co ratio | Mn atom % | Co atom % | Cu atom % | Al atom % | Fe atom % | Ni atom % | Sr atom % | Electrical characteristics ρ25 Ωcm | Electrical characteristics B25/50 K | ΔR25% after application of inrush current | Plate crystal | Judgement |
|---|---|---|---|---|---|---|---|---|---|---|---|---|---|
| 801 | 60/40 | 57.0 | 38.0 | 5.0 | — | — | — | — | 453 | 3684 | 6 | Yes | ○ |
| 802 | | 55.8 | 37.2 | 7.0 | — | — | — | — | 181 | 3421 | 7 | Yes | ○ |
| 803 | | 52.8 | 35.2 | 7.0 | — | — | — | 5.0 | 109 | 3228 | 3 | Yes | ○ |
| 804 | | 49.8 | 33.2 | 7.0 | — | — | — | 10.0 | 121 | 3304 | 41 | No | X |
| 805 | 70/30 | 63.0 | 27.0 | 10.0 | — | — | — | — | 290 | 3250 | 7 | Yes | ○ |
| 806 | | 64.8 | 27.7 | 7.5 | — | — | — | — | 604 | 3407 | 3 | Yes | ○ |
| 807 | | 60.5 | 26.0 | 7.5 | — | — | 5.0 | 1.0 | 83 | 3052 | −1 | Yes | ○ |
| 808 | | 59.5 | 25.5 | 7.5 | — | — | 5.0 | 2.5 | 83 | 3010 | 0 | Yes | ○ |
| 809 | | 57.7 | 24.8 | 7.5 | — | — | 5.0 | 5.0 | 67 | 2966 | 0 | Yes | ○ |
| 810 | | 54.2 | 23.3 | 7.5 | — | — | 5.0 | 10.0 | 102 | 3024 | 33 | No | X |
| 811 | | 60.5 | 26.0 | 7.5 | 5.0 | — | — | 1.0 | 105 | 3109 | −1 | Yes | ○ |
| 812 | | 57.7 | 24.8 | 7.5 | 5.0 | — | — | 5.0 | 89 | 3004 | 0 | Yes | ○ |
| 813 | | 54.2 | 23.3 | 7.5 | 5.0 | — | — | 10.0 | 129 | 3018 | 41 | No | X |
| 814 | | 57.7 | 24.8 | 7.5 | — | 5.0 | — | 5.0 | 154 | 3127 | 1 | Yes | ○ |
| 815 | | 54.2 | 23.3 | 7.5 | — | 5.0 | — | 10.0 | 166 | 3144 | 53 | No | X |
| 816 | 80/20 | 66.6 | 16.7 | 16.7 | — | — | — | — | 129 | 2783 | 8 | Yes | ○ |
| 817 | | 70.8 | 17.7 | 11.5 | — | — | — | — | 278 | 2959 | 5 | Yes | ○ |
| 818 | | 70.0 | 17.5 | 11.5 | — | — | — | 1.0 | 184 | 2947 | 2 | Yes | ○ |
| 819 | | 66.8 | 16.7 | 11.5 | — | — | — | 5.0 | 119 | 2963 | −2 | Yes | ○ |
| 820 | | 62.8 | 15.7 | 11.5 | — | — | — | 10.0 | 133 | 3005 | 26 | No | X |
| 821 | | 66.8 | 16.7 | 11.5 | 5.0 | — | — | — | 523 | 3005 | 3 | Yes | ○ |
| 822 | | 66.0 | 16.5 | 11.5 | 5.0 | — | — | 1.0 | 322 | 2820 | 0 | Yes | ○ |
| 823 | | 64.8 | 16.2 | 11.5 | 5.0 | — | — | 2.5 | 231 | 2803 | 2 | Yes | ○ |
| 824 | | 62.8 | 15.7 | 11.5 | 5.0 | — | — | 5.0 | 282 | 2823 | 1 | Yes | ○ |
| 825 | | 58.8 | 14.7 | 11.5 | 5.0 | — | — | 10.0 | 96 | 2845 | 24 | No | X |
| 826 | | 58.8 | 14.7 | 11.5 | 15.0 | — | — | — | 121 | 2795 | 2 | Yes | ○ |
| 827 | | 54.8 | 13.7 | 11.5 | 15.0 | — | — | 5.0 | 65 | 2803 | −1 | Yes | ○ |
| 828 | | 50.8 | 12.7 | 11.5 | 15.0 | — | — | 10.0 | 74 | 2855 | 37 | No | X |
| 829 | | 66.8 | 16.7 | 11.5 | — | 5.0 | — | — | 682 | 3019 | 2 | Yes | ○ |
| 830 | | 62.8 | 15.7 | 11.5 | — | 5.0 | — | 5.0 | 364 | 2929 | 1 | Yes | ○ |
| 831 | | 58.8 | 14.7 | 11.5 | — | 5.0 | — | 10.0 | 523 | 2932 | 19 | No | X |
| 832 | | 56.8 | 14.2 | 14.0 | — | 15.0 | — | — | 320 | 2912 | 2 | Yes | ○ |
| 833 | | 52.8 | 13.2 | 14.0 | — | 15.0 | — | 5.0 | 190 | 2876 | 1 | Yes | ○ |
| 834 | | 48.8 | 12.2 | 14.0 | — | 15.0 | — | 10.0 | 214 | 2881 | 52 | No | X |
| 835 | | 66.8 | 16.7 | 11.5 | — | — | 5.0 | — | 157 | 2759 | 3 | Yes | ○ |
| 836 | | 66.0 | 16.5 | 11.5 | — | — | 5.0 | 1.0 | 201 | 3007 | 1 | Yes | ○ |
| 837 | | 64.8 | 16.2 | 11.5 | — | — | 5.0 | 2.5 | 217 | 3058 | −1 | Yes | ○ |
| 838 | | 62.8 | 15.7 | 11.5 | — | — | 5.0 | 5.0 | 148 | 2929 | 2 | Yes | ○ |
| 839 | | 58.8 | 14.7 | 11.5 | — | — | 5.0 | 10.0 | 121 | 2689 | 22 | No | X |
| 840 | | 60.8 | 15.2 | 9.0 | — | — | 15.0 | — | 72 | 3014 | 6 | Yes | ○ |
| 841 | | 56.9 | 14.2 | 9.0 | — | — | 15.0 | 5.0 | 41 | 2982 | 2 | Yes | ○ |
| 842 | | 52.8 | 13.2 | 9.0 | — | — | 15.0 | 10.0 | 52 | 2994 | 44 | No | X |
| 843 | 90/10 | 70.2 | 7.8 | 22.0 | — | — | — | — | 312 | 2512 | 7 | Yes | ○ |
| 844 | | 74.7 | 8.3 | 17.0 | — | — | — | — | 237 | 2732 | 5 | Yes | ○ |
| 845 | | 70.2 | 7.8 | 17.0 | — | — | — | 5.0 | 109 | 2766 | 3 | Yes | ○ |
| 846 | | 65.7 | 7.3 | 17.0 | — | — | — | 10.0 | 127 | 2745 | 36 | No | X |
| 847 | 100/0 | 66.7 | — | 33.3 | — | — | — | | 229 | 2889 | 24 | No | X |

As shown in Table 18, among all samples of NTC thermistors, for composition Nos. 801 to 803, 805 to 809, 811, 812, 814, 816 to 819, 821 to 824, 826, 827, 829, 830, 832, 833, 835 to 838, 840, 841, and 843 to 845, when the atomic (manganese content)/(cobalt content) ratio is 60/40 or more and 90/10 or less, 22 at % or less copper is present, at least one of 15 at % or less aluminum, 15 at % or less iron, and 15 at % or less nickel is further present, and 5 at % or less (excluding 0%) strontium is also present, not only plate crystals mainly composed of manganese oxide serving as the second phase having a high electrical resistance but also $SrMnO_3$ serving as a third phase having a high electrical resistance is dispersed in the first phase, i.e., the matrix having a low electrical resistance. Thus, the electrical current concentration on the first phase is moderated, fracture caused by heat melting is suppressed, and the voltage resistance can be improved further.

Example 9B

Green sheets obtained in EXAMPLE 9A were used to prepare a multilayer NTC thermistor shown in FIG. 3 as in EXAMPLE 2B.

The voltage resistance was evaluated by supplying inrush current to the multilayer NTC thermistor. The changes in electrical resistance after application of inrush current and the rate of change in electrical resistance ΔR25 were measured and calculated as in EXAMPLE 1B. From composition Nos. 817 and 819 shown in Table 18, multilayer NTC thermistors were prepared, and the inrush current value was varied to measure changes in electrical resistance at the inrush current value and to calculate the rate of change in electrical resistance ΔR25. The results are shown in FIG. 21.

Figure 21:
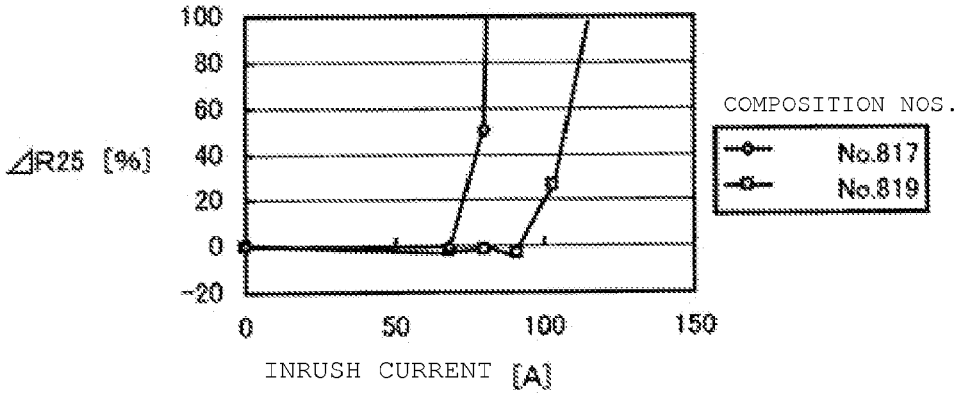
FIG. 21 is a graph showing the relationship between the inrush current value and rate of change in electrical resistance ΔR25 of multilayer NTC thermistors prepared from several compositions of EXAMPLE 9A.

FIG. 21 shows that compared with composition No. 817 containing no strontium, composition No. 819 containing strontium does not undergo changes in electrical resistance until a relatively high inrush current value is reached. Adding strontium can further improve the voltage resistance.

The embodiments and examples disclosed herein are merely examples and should not be construed as limiting in all aspects. The scope of the present invention is solely defined by the claims and not by the embodiments and examples described above, and includes equivalents to the terms of the claims and all modifications and alterations within the scope of the claims.

INDUSTRIAL APPLICABILITY

This invention is applicable to a NTC thermistor ceramic suitable for use in a NTC thermistor for limiting inrush current that occurs when a power switched is turned ON-OFF, and to a NTC thermistor. The invention can improve the voltage resistance of the NTC thermistor ceramic and provide an inrush current-limiting NTC thermistor including the NTC thermistor ceramic and having high voltage resistance.

The invention claimed is:

1. A NTC thermistor ceramic comprising: a first phase, which is a matrix, and a second phase dispersed in the first phase, wherein the second phase includes crystals having an average aspect ratio of at least about 3:1 and has an electrical resistance higher than that of the first phase;

wherein the first phase has a spinel structure, the first and second phases contain manganese and nickel, and the atomic manganese/nickel content ratio of the NTC thermistor ceramic as a whole is 87/13 to 96/4, and the NTC thermistor ceramic contains 0 at % to 15 at % copper, 0 at % to 10 at % aluminum, 0 at % to 10 at % iron, 0 at % to 15 at % cobalt, and 0 at % to 5 at % titanium, and further contains at least one element selected from the group consisting of calcium and strontium, the calcium content being 10 at % or less (excluding 0 at %) and the strontium content being 5 at % or less (excluding 0 at %).

2. The NTC thermistor ceramic according to claim 1, wherein the manganese content in the second phase is higher than that in the first phase.

3. The NTC thermistor ceramic according to claim 2, further comprising a third phase dispersed in the first phase, wherein the third phase is different from the second phase and has an electrical resistance higher than that of the first phase.

4. The NTC thermistor ceramic according to claim 3, wherein the third phase contains an alkaline earth metal.

5. A NTC thermistor comprising a thermistor element body composed of the NTC thermistor ceramic according to claim 3 and an electrode disposed on a surface of the thermistor element body.

6. A NTC thermistor comprising a thermistor element body composed of the NTC thermistor ceramic according to claim 2 and an electrode disposed on a surface of the thermistor element body.

7. The NTC thermistor ceramic according to claim 1, wherein the first phase has a spinel structure, the first and second phases contain manganese and cobalt, and the atomic manganese/cobalt content ratio of the NTC thermistor ceramic as a whole is 60/40 to 90/10, and the NTC thermistor ceramic contains 0 at % to 22 at % copper, 0 at % to 15 at % aluminum, 0 at % to 15 at % iron, and 0 at % to 15 at % nickel, and further contains at least one element selected from the group consisting of calcium and strontium, the calcium content being 5 at % or less (excluding 0 at %) and the strontium content being 5 at % or less (excluding 0 at %).

8. A NTC thermistor comprising a thermistor element body composed of the NTC thermistor ceramic according to claim 7 and an electrode disposed on a surface of the thermistor element body.

9. The NTC thermistor ceramic according to claim 1, further comprising a third phase dispersed in the first phase, wherein the third phase is different from the second phase and has an electrical resistance higher than that of the first phase.

10. The NTC thermistor ceramic according to claim 9, wherein the third phase contains an alkaline earth metal.

11. A NTC thermistor comprising a thermistor element body composed of the NTC thermistor ceramic according to claim 10 and an electrode disposed on a surface of the thermistor element body.

12. A NTC thermistor comprising a thermistor element body composed of the NTC thermistor ceramic according to claim 9 and an electrode disposed on a surface of the thermistor element body.

13. A NTC thermistor comprising a thermistor element body composed of the NTC thermistor ceramic according to claim 1 and an electrode disposed on a surface of the thermistor element body.

* * * * *